US005730331A

United States Patent [19]

Johnson

[11] Patent Number: 5,730,331

[45] Date of Patent: Mar. 24, 1998

[54] SUBSTITUTE LID DEVICE

[76] Inventor: Robert Elliott Johnson, #101-36 South Turner Street, Victoria, B.C., Canada, V8V 2J6

[21] Appl. No.: 715,929

[22] Filed: Sep. 15, 1996

[51] Int. Cl.[6] ..... B67D 5/60

[52] U.S. Cl. ..... 222/143; 222/556; 222/570; 220/701

[58] Field of Search ..... 222/185.1, 541.5, 222/556, 570, 143; 220/695, 699–701, 797–798, 802, 339, 337; 206/508, 509

[56] References Cited

U.S. PATENT DOCUMENTS

| | | | |
|---|---|---|---|
| 2,084,084 | 6/1937 | Greer | 220/798 |
| 2,627,367 | 2/1953 | Bork | 222/570 |
| 2,646,193 | 7/1953 | Best | 222/570 |
| 2,722,347 | 11/1955 | Henke | 222/570 |
| 2,786,614 | 3/1957 | Giusto | 222/570 |
| 3,180,537 | 4/1965 | Collins | 222/143 |
| 3,695,488 | 10/1972 | Olsson | 222/570 |
| 3,899,107 | 8/1975 | Gaal | 222/570 |
| 4,203,537 | 5/1980 | McAlister | 222/570 |
| 4,225,064 | 9/1980 | Westcott | 222/570 |
| 5,012,960 | 5/1991 | Arnold | 222/570 |
| 5,161,689 | 11/1992 | Balson | 206/508 |

*Primary Examiner*—Philippe Derakshani
*Attorney, Agent, or Firm*—Jim Zegeer, Esq.

[57] ABSTRACT

A substitute lid for use in association with a container, such as paint cans and the like, when the contents of the can are being poured or dipped by a brush therefrom. The lid is of a flat design and includes a peripheral flange having an inner surface for closely engaging one end of the can so that the lid can be removably attached to one end of the can such as when the can is sold for later removal of the contents by the user. A ridge or tabs can be provided around the periphery and project from a side of a flat body portion of the lid opposite to the flange so as to provide a nesting effect between cans piled in a stack. Adjacent the flange a groove sealing portion of the lid may be provided so as to seal the upwardly open groove commonly present in such cans for maintaining the usual can lid in a closed sealed condition. A pouring spout is either formed as part of the lid or as an attachment thereto and is movable from a flat position to a raised position when the substitute lid is moved to the top of the can after removal of the usual lid so as to assist in achieving a controlled pour of the contents from the open can.

28 Claims, 15 Drawing Sheets

SUBSTITUTE LID DEVICE

BACKGROUND OF THE INVENTION

1. Field of the Invention

This invention relates to a substitute lid device for use in association with cans, and more particularly to lids for removable attachment to cans such as those containing liquids, such as paint and the like.

2. Description of Prior Art

For many years paint and other products have been sold in cans which include a top closure in the form of a lid having a downwardly projecting peripheral ridge usually formed by a reverse bend and which is tightly received in an annular groove extending about the top of the can immediately inside of the cylindrical side wall of the can. This structure provides a good initial seal for the contents and the lid is conveniently removable and then replaceable when the can contents are to be further kept without exposure to the atmosphere. A common problem in the use of such cans is that when the can is opened and the contents poured therefrom or the paint is used directly from the can by dipping a paint brush, paint enters the groove, and the presence of the paint in the groove when the lid is replaced eventually affects the seal and/or causes problems when the lid is to be removed at a later time. Also when paint is poured from a can of the above described type the flow of paint is somewhat difficult to control, and because of the presence of the groove, there is a tendency for the paint to continue to run down the side of the can as the pouring is stopped. Because of the nature of paint, spillage of paint when pouring can have serious consequences.

There have been developed spout devices which are attachable to an opened paint can so as to allow for more controlled pouring of paint and the like from cans as described above. One such device is shown in U.S. Pat. No. 3,695,488, Oct. 3, 1972, Olsson. Other pouring devices include means for also sealing the groove of the can when the device is installed on the opened can. Such devices are shown in U.S. Pat. No. 2,627,367, Feb. 3, 1953, Bork; U.S. Pat. No. 2,646,193, Jul. 21, 1953, Best; U.S. Pat. No. 3,899,107, Aug. 12, 1975, Goal; U.S. Pat. No. 4,203,537, May 20, 1980, McAlister, U.S. Pat. No. 4,225,064, Sep. 30, 1980, Westcott; and U.S. Pat. No. 5,012,960, May 7, 1991, Arnold. In the main, such structures have tended to be bulky and of a type which would normally be marketed as a separate item in a paint store or the like. The device of above-mentioned U.S. Pat. No. 3,695,488 is an exception, but the device in this patent functions only as a simple spout. It includes ears which the patent suggests can be used to attach the spout to a display base or card. In any event, it is not uncommon for the user of the paint, not to contemplate the difficulties frequently encountered when pouring paint or in dealing with the paint accumulated in the groove of the can until the painting job is in progress, and at that state, it is unlikely that the user is prepared to revisit the store to retrieve such a device. Also if one has had the foresight to purchase such a device, it is not uncommon because of its condition after one or more uses to discard it and not maintain it until the next paint job.

The cans used for retailing paint and similar products have become very standard in structure. A bead is formed at the bottom in attaching the bottom of the can to the cylindrical wall portion, and another bead is formed at the top in attaching the groove forming element to the cylindrical wall portion. These beads form the extremities of the peripheral top and bottom edges of the can, and as such peripheral edges are of the same diameter, there is no provision of nesting of stacked cans. The cans which are formed of smooth metal are therefore free to slide sideways relative to each other when stacked one on the other. Thus, if stacked for display or storage the cans which are heavy, are vulnerable to tumbling which results in damage to the can and possibly injury to persons in the area. Also the lack of stability of stacked cans has a detrimental affect on the manner in which the cans can be handled when the filled cans are being prepared for filling, during filling and when subsequently shipped and stored.

SUMMARY OF THE INVENTION

It is the object of the present invention to provide a substitute lid for a can of the type containing liquids and the like and which can be temporarily attached to one end of the can for removal and use by the end user.

It is another object of the present invention to provide a substitute lid for a can, which when temporarily attached to one end of the can, permits a nesting feature with the opposite end of a like can when the cans are stacked one upon the other.

Yet another object of the present invention is to provide a substitute lid which can be attached to one end of a can, such as a paint can, as produced and sold and which can be removed by the end user and attached to the top of the can after the normal can lid is removed so as to protect the top annular groove of the can when the paint is poured or dipped from the can.

Still yet another object of the invention is to provide a substitute flat lid for a can, such as a paint can which has means for temporarily attaching to one end of the can as sold and which includes a pouring spout having an attachment allowing the spout to be moved to a raised pouring position.

According to one aspect of the present invention there is provided a substitute lid for containers or cans of the type having a tubular body and flat top and bottom closure means joined to opposite end portions of the tubular body. The lid includes a substantially flat central portion having an outer periphery with a flange adjacent the outer periphery and projecting axially from one side thereof. The flange has an inner surface sized to encompass and engage one end portion of a first one of the containers for thereby attaching the lid to the container. The lid has an annular nesting means adjacent the outer periphery of its body portion and projecting axially from a side thereof opposite to the flange. The nesting means has an inner surface dimensioned to closely encompass an end portion of a second like can whereby the cans can be stacked one upon the other in a nesting relationship.

Thus, it may be seen that the lid of the present may be attached to the bottom of the can as sold, for example, for removal and use by the user of the contents of the can. The attachment of the lid to the can may be carried out after the manufacture of the can itself, at the time of the filling of the can or by the retailer. However, as attached, it can provide for stable stacking of the cans, during the storage, shipping and displaying of the filled cans prior to the final sale to the end user.

According to another aspect of the present invention, there is provided a substitute lid for a can of the type for containing contents, such as paint and the like, and having a tubular body, a flat bottom and a top closure means at top end of the body, the top closure means including means forming an upward facing groove integrally within an upper end of the tubular body and a removable top lid having a downwardly projecting flange means for tight engagement within the groove. The substitute lid includes a substantially flat body portion defining an opening therethrough, the body portion being disposed within an outer periphery which is substantially equal in size and shape to the body of the can. A flange is provided about the periphery of the body portion and projects axially from a side of the body portion of the lid. The flange has an inner surface sized to closely encompass and tightly engage a portion of the can at one end of the tubular body. The flange removably holds the substitute lid juxtaposed one end of the can and has groove closure means disposed radially inwardly of the flange and projecting from the same side of the body portion as the flange. The substitute lid is removable from the one end of the can and is attachable over the top end subsequent to the removal of the top lid of the can so that the groove closure means contacts the groove forming means when the substitute lid is attached over the top end of the can and prevents entry of the can contents into upward facing groove during the contents removal from the container through the opening in the substitute lid.

Accordingly, when the can of paint or other contents is sold with the substitute lid attached to one end, the substitute lid is readily available to the end user who can remove the substitute lid from which ever end of the can to which it is attached and after removing the regular can lid, the substitute lid is attached to the top to assist in the controlled pouring of the liquid through the opening in the substitute lid while preventing entry of the liquid into the upward facing groove of the can. Similarly, during use of the can contents, such as by removing it from the can by dipping a paint brush through the opening of the substitute lid, the liquid cannot enter the groove of the can.

In yet another form of the invention, there is provided a pouring device for use with a can of the type for containing contents, such as paint and like contents, wherein the can has a cylindrical wall portion, a relatively flat bottom closure member and a top closure means including a removable top lid. The pouring device includes a substitute lid provided by a substantially flat body portion formed of plastic-like material, the body portion of the substitute lid having a means defining a pouring opening therethrough and a circular outer periphery of a diameter substantially equal to that of the cylindrical wall portion of the can. A circular flange extends about the periphery of the body portion and projects axially from one side thereof, the circular flange having an inner face of a diameter for closely encompassing a portion of the can adjacent one end thereof so as to allow removable attachment of the device to the one end of the can. The device also includes a pouring spout means movable from a flat relationship to the body portion and to a raised pouring position. Thus, on removal of the top lid from the can, the pouring device can be removed from the one end of the can and attached to the top end of the can, and the pouring spout means can be moved to the raised positions to assist in controlled pouring of the contents from the can.

DESCRIPTION OF PREFERRED EMBODIMENT OF THE INVENTION

Figure 6:
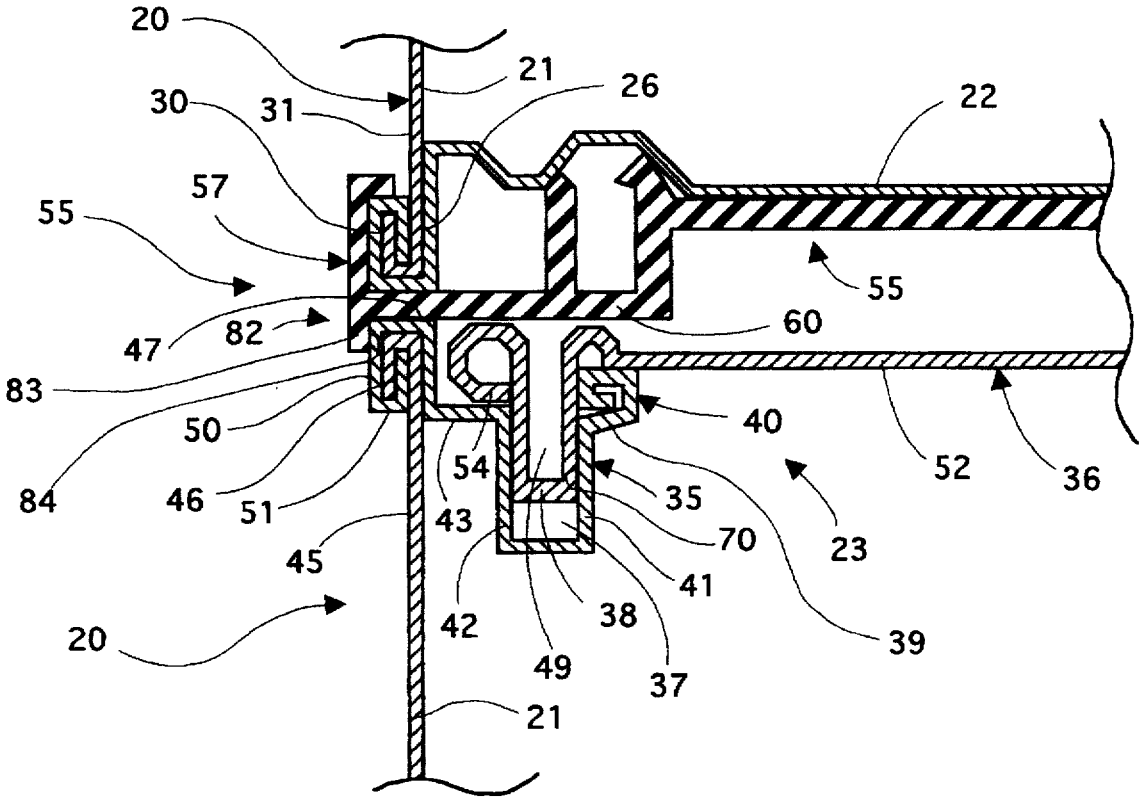
FIG. 6 is a partial cross-sectional view as seen from the line 6—6 of FIG. 5, but on an enlarged scale, and illustrating the nesting relationship provided by the substitute lid which is removably attached to the bottom end portion of the uppermost can.

Referring to the accompanying drawings in which reference characters are used to denote like parts referred to herein, the reference character 20 generally denotes a container of the type in which liquids, such as paint and the like, are commonly sold to the public. Such a container, usually referred to as a can, is sold in a number of sizes, the larger of which is usually a quart and gallon can, or alternatively in nominally one liter and four liter sizes. For contents such as paint, the cans are formed of metal and are of a relatively standard construction consisting of a tubular body 21, a bottom member 22 (FIG. 2) and a top closure means 23 (FIG. 6). The tubular body 21 is usually of circular cross-section, i.e. of cylindrical form. As most readily seen in FIG. 2 and FIG. 6 the bottom member 22 is in the main relatively flat, but has near its outer periphery a slight corrugated effect provided by a first annular trough portion 24 and a second annular inverted trough portion 25 radially inward from the first annular trough portion 24. The bottom member 22 has outwardly of the trough portion 24 a short downwardly projecting peripheral flange 26 which is in effect rolled upwardly with a lowermost portion 27 of the tubular body 21 to form a bottom bead 30 which is disposed radially outward of an exterior cylindrical wall surface 31 of the tubular body 21. The bead 30 has a bottom edge surface 32, a short exterior cylindrical surface 33 and a top ledge surface 34. As is readily apparent, the described structure results in the bottom member 22 being slightly recessed relative to the bottom edge surface 32 provided by the bottom bead 30.

The top closure means 23 includes an annular groove 37 forming element 35 and a top closure lid 36 (FIG. 6). The annular groove forming element is pressed from an annular member to include a reverse bend providing the upwardly facing annular groove 37. The portion of the annular element 35 adjacent the innermost edge thereof is effectively rolled on itself to conceal the innermost edge within a roll 40 located at the top of an innermost wall 41 of the groove 37. The roll 40 provides the inner edge of the element 35 and thus the outer rim of the top opening of the can 20 normally closed by the lid 36. The roll 40 provides exterior and radially inward of the annular groove 37 a lower lip surface 39. Projecting radially outward from an outermost wall 42 of the groove 37 is a short web 43 jointed to a short upwardly extending peripheral flange 44, which, like flange 26 of the bottom member 22, is in effect rolled downwardly with an uppermost portion 45 of the tubular body 21 to form a top bead 46. Like bead 30, the top bead 46 is disposed radially outward of the exterior cylindrical wall surface 31. The top bead 46 has a top edge surface 47, a short exterior surface 50 and a bottom ledge surface 51 (FIG. 6).

Figure 4:
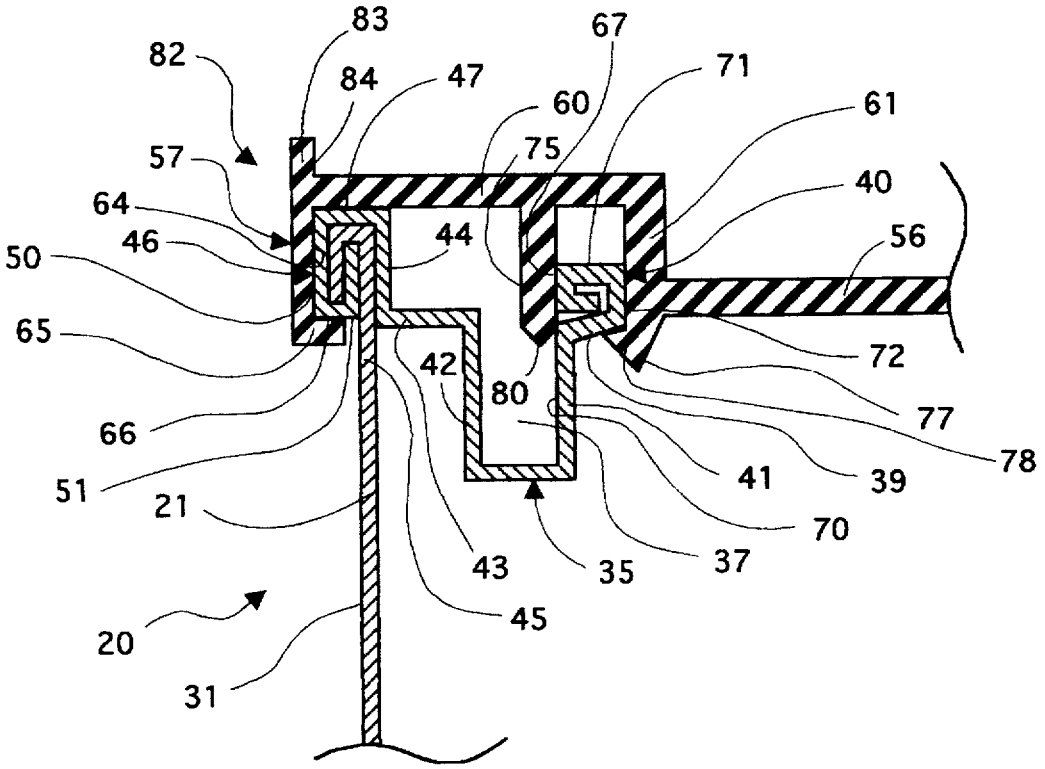
FIG. 4 is a partial cross sectional view as seen from the line 4—4 of FIG. 3, but on an enlarged scale, and illustrating the substitute lid as attached to the top end of the can after the removal of a top lid of the can.

The top closure lid 36 which is first applied to the can after filling has a substantially flat central portion 52 and a peripheral downwardly extending flange 38 formed by a reverse bend sized to be received within the upward facing groove 37. The flange 38 is designed to tightly hold the top closure lid 36 in place when it is fixed into the groove 37. The top closure lid 36 can be removed when the user of the contents wishes access to the contents by inserting a tool, such as the end of a screw driver, in the space between a peripheral roll 54 at the outermost periphery of the top closure lid 36 and the roll forming the bead 46, and then prying up the edge of the top closure lid 36 upwardly. The upper portion of the can with the lid removed is shown in FIG. 4. To reclose the can the top closure lid 36 is put in place with the bottom of the annular flange 38 over the upper part of the groove 37. The rim of the top closure lid is then pressed or tapped to move the closure lid 36 into a closed condition.

When the top closure lid 36 is in its firmly sealed position the peripheral roll 54 of the top closure lid 36 is at the same level or slightly below the top edge 46 of the bead 48. As previously indicated the above described container structure is relatively standard, and it can be seen that when one can 20 is normally stacked on another can 20, the bottom edge surface 32 of the bottom bead 30 of the upper can rests directly on top of the top edge surface 47 of the top bead 46 of the lower can. The contact of these smooth tin plated surfaces of the metal cans result in considerable instability when cans are stacked.

Figure 1:
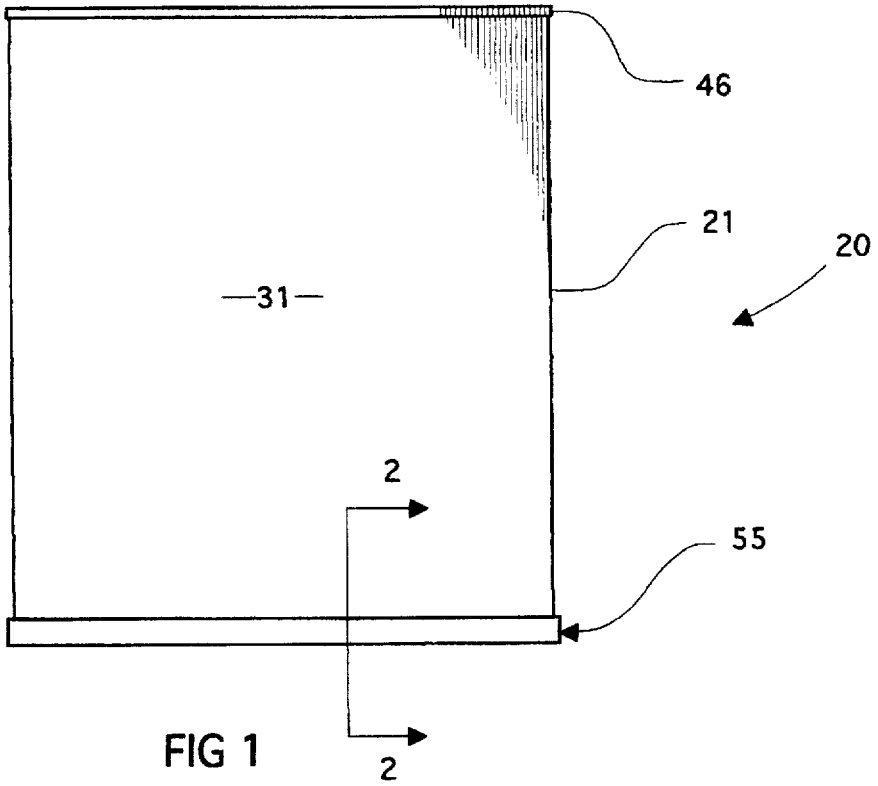
FIG. 1 is a side view of a can, such as that used for containing paint and showing a substitute lid according to the present invention attached to the bottom end of the can.

Referring again to FIGS. 1 and 2 a substitute lid 55 of the present invention is shown attached to the bottom of a container or can 20. It is suggested that the substitute lid 55 may be attached to the can at the time of manufacture of the can so as to facilitate handling and storage of the can in its empty form prior to filling, or after filling to facilitate shipping and storage of the filled can. Alternatively the substitute lid 55 might be applied to the bottom of the can at the retail level to allow for safe stacking of the cans for storage and display. It is in any event preferable that the substitute lid 55 be in a removably attached condition when the can is purchased by the end user so that it may be utilized by that person as will be more fully described below. It may also be appreciated that while the embodiment of the substitute lid 55 illustrated herein is particularly designed for being removably attached to the bottom of the can 20, it may be provided in a form for removably attached to the top of the can to provide the nesting feature and to then be removed by the end user for reattachment to the top after the removal of top closure lid 36 prior to removal of the paint or other container contents from the can 20.

Figure 2:
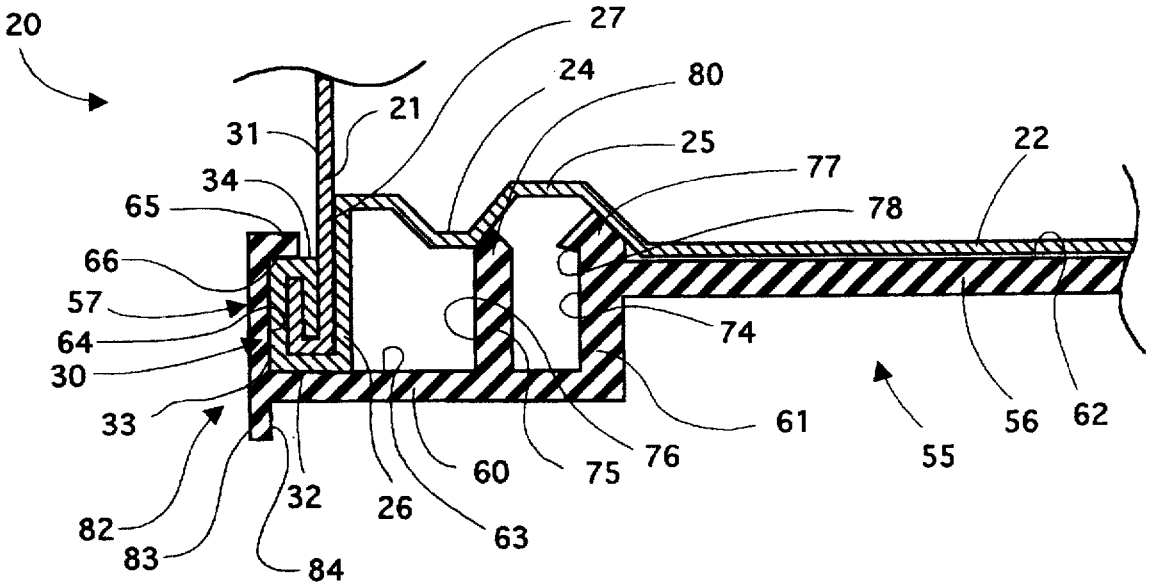
FIG. 2 is a partial cross-sectional view as seen from the line 2—2 of FIG. 1 but on an enlarged scale.
Figure 3:
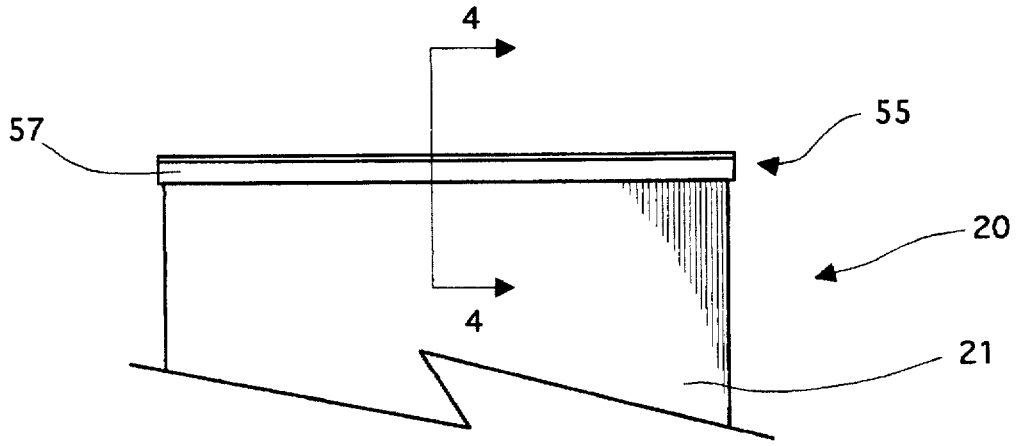
FIG. 3 is a partial side view of the top portion of the can with the substitute lid attached to the top of the can.

As can best be seen in FIG. 2, the substitute lid 55, which is preferably formed of a non-brittle plastic-like material having some resiliency, has a substantially flat central portion 56, and a flange 57 about its periphery. The substitute lid is substantially of the same shape and size as the end of the can. Thus, normally the substitute lid is generally in the form of a circular disk, and the flange 57, which is relatively short, projects in an inward axial direction relative to the central portion 56.

In the embodiment illustrated in FIG. 2 and FIG. 4, the central portion 56, which is relatively thin, surrounded about the periphery thereof by an outer annular section including a flat annular web portion 60. The web portion 60 is in a plane parallel to and spaced slightly outward from the plane of the central portion 56. The web portion 60 is joined to annular web portion 60 by a short axially extending flange portion 61 projecting outward of the central portion 56. As can be seen, the flange 61 is of cylindrical form projecting substantially at right angles relative to the substantially flat central portion 56, and is concentrically disposed within flange 57. The axial spacing of the central portion 56 and the web portion 60 may be selected so that an inner flat surface 62 of the central portion 56 is in close proximity to the bottom of the bottom member 22 when an inner flat surface 63 of the web portion 60 is juxtaposed the bottom edge surface 32 of the bottom bead 30 of the can.

The flange 57 has an inner cylindrical surface 64 sized to closely encompass the end portion of the can, i.e. it has a diameter approximately equal to the diameter of the outer cylindrical surface 33 and 50 of the bottom and top beads 30, 46, respectively.

At the inner end of the flange 57 there is provided a short lip 65 which projects radially inward. The lip 65 has a bead engaging surface 66 which is axially spaced from the inner flat surface 63 a distance substantially equal to the height of the bottom and top beads. Thus, when the substitute lid 55 is pushed over either the bottom or top portion of the can 20 the lip snaps into place as the inner flat surface 63 comes into engagement with either the bottom edge surface 32 or the top edge surface 47 of the respective beads. Accidental removal of the substitute lid 55 is thus prevented by the engagement of the bead engaging surface 66 of the lip 65 with the top ledge surface 34 of the bottom bead 30 or the bottom ledge surface 51 of the top bead 46 as illustrated in FIG. 2 and FIG. 4, respectively.

The roll 40 at the innermost upper edge of the annular groove 37 has an outer cylindrical edge surface 67 which is flush with the surface 70 of the inner wall 41 of the groove 37. The roll further defines a top edge surface 71, inner edge surface 72 and the lower surface 39. An outer cylindrical wall surface 74 of the flange portion 61 is spaced a distance radially inward from inner cylindrical surface of the flange 57 a distance substantially equal to the radial distance between the inner edge surface 72 of the roll 40 and the exterior surface 50 of the top bead 46 of the can 20. The flange 61 extends axially inward past the inner surface 62 of the central portion 56 of the substitute lid and terminates with a pointed ridge 77 providing a lip 78 projecting radially outward of the exterior cylindrical surface 74 of the flange 61. There is provided a second flange 75 projecting axially inward and parallel to flange 61. The flange 75 has an inner cylindrical surface 76 which is radially spaced from the inner cylindrical surface 64 of the flange 57 a distance substantially equal to the distance between the outer edge surface 67 of the roll 40 and the exterior surface 50 of the top bead 46. A free end edge 80 of the flange 75 is preferably tapered to provide a point.

As is apparent from FIG. 4, as the substitute lid is installed over the open upper end of the can, the lip 65 moves down and eventually snaps under the bottom ledge surface 51 of the top bead 46, and the parallel flanges 61 and 75 slide past inner edge surface 72 and outer edge surface 67, respectively, of the roll 40. The flanges are easily directed to either side of the roll 40 by the pointed ridge 77 of the flange 61 and the pointed free end 80 of the flange 75. As the lip 65 snaps under the bottom ledge surface 51 of the top bead, the lip 78 of the flange 61 snaps under the lower edge surface 39 of the roll 40. Thus the flanges 61 and 75 together with the annular web 60 of the substitute lid provide a groove closure means which prevents entry of the contents of the can 20 into the groove 37 during removal of the contents from the container.

Figure 7A:
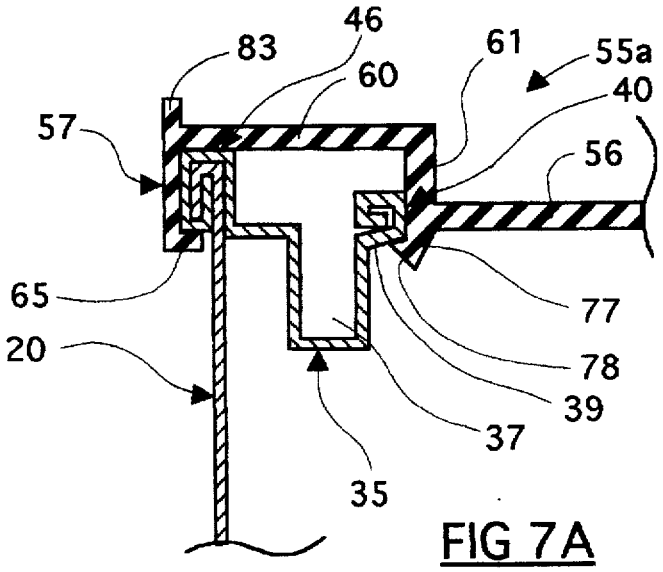
FIG. 7A–7F are partial cross sectional views similar to FIG. 4, but showing alternative configurations for the groove closure means.

In an alternative form of the groove closure means shown in FIG. 7A, it may be noted that the additional flange 75 of the embodiment shown in FIGS. 2, 4 and 6 has been omitted. The groove is still isolated from the paint or other liquid within the can because of the presence of the web 60 and the flange 61 even when the paint is poured or dipped from the can 20, particularly because of the seal formed by the engagement of the web 60 with the top edge surface 47 of the bead 46 and by the seal formed by the lip 77 of the flange 61 snapped below at the lower edge surface 39 of the roll 40.

Figure 7B:
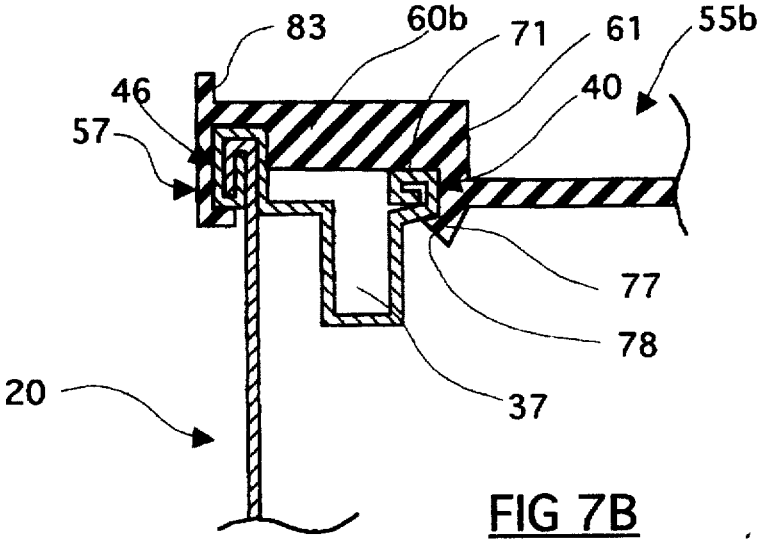

The embodiment shown in FIG. 7B is somewhat similar to that of FIG. 7A but the web 60 is formed of thicker material so that it engages the top edge surface 71 of the roll 40. Because of the manner in which this embodiment causes the web **60*b* to encompass the upper part of the bead 46 and of the way the web 60*b* causes a tighter enclosure of the roll 40, the embodiment of FIG. 7B provides an even more effective enclosure of the groove 37** during pouring of the contents from the can.

Figure 7C:
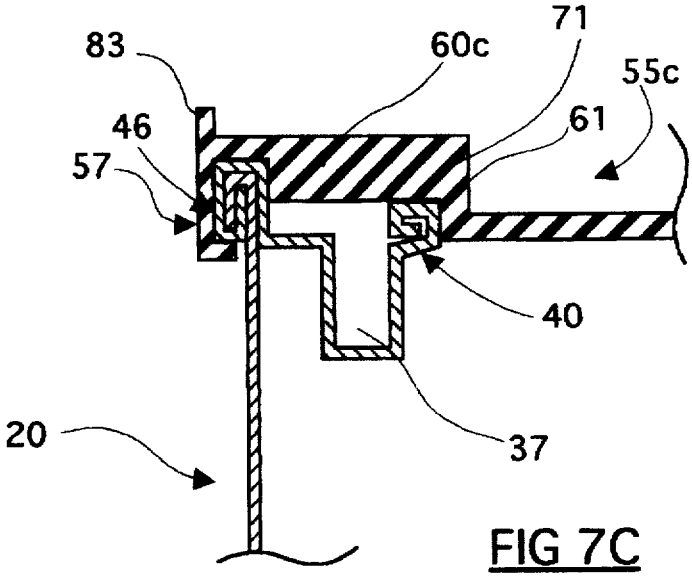

The embodiment of FIG. 7C is substantially the same as that of FIG. 7B, except the design has been slightly simplified by omitting the pointed ridge 77 and the lip 78. While still providing the more effective seal of the bead 46, the seal at the roll 40, while possibly as effective as that of the embodiment in FIGS. 2, 4 and 6, may be less effective than that of FIG. 7B.

Figure 7D:
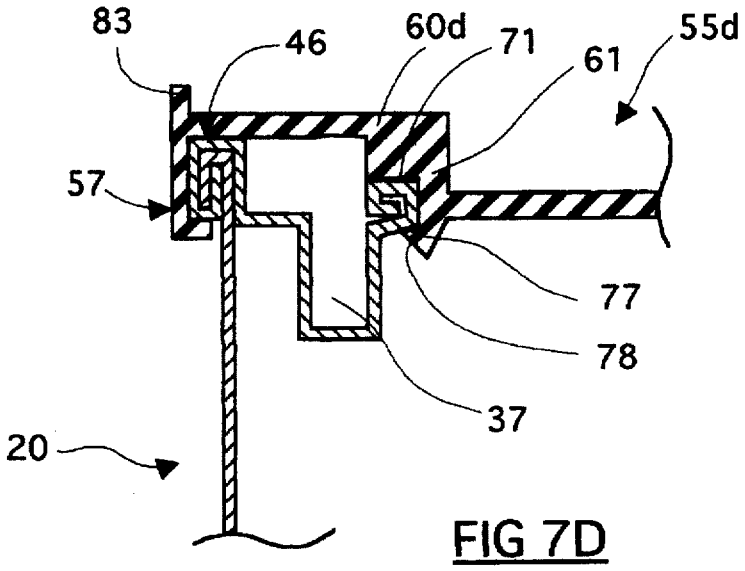

In the embodiment of FIG. 7D, the web **60*d* has a thickened portion adjacent flange 61 so as to engage the top edge surface 71 of the roll 40. This arrangement provides an enhanced seal at the roll 40**, as compared to the first embodiment described above.

Figure 7E:
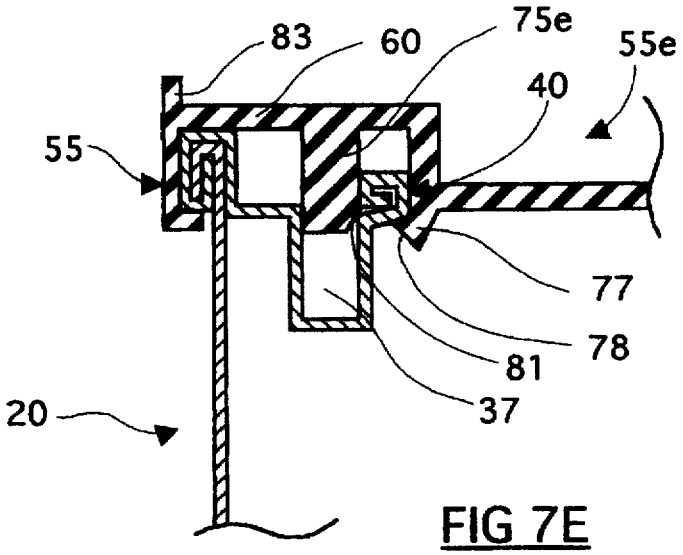
Figure 7F:
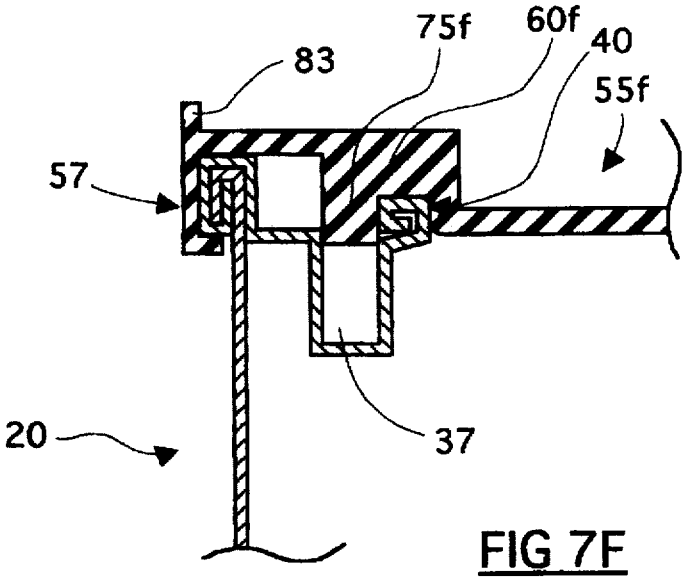

The substitute lid **55*e* shown in the embodiment illustrated in FIG. 7E is the same as that of FIGS. 2, 4 and 6 except that the flange 75*e* is of a thickness substantially equal to the width of the groove 37 so that as the substitute lid 55*e* is applied to the top of an open can 20, the flange 75*e* fills the annular open top of the groove 37. A bottom edge surface of the flange 75*e* may have slanted face portion as shown at 81 so as to assist in the lower portion of the flange clearing the top edge surface 71 of the roll 40 which the flange encounters prior to entering the groove 37. The embodiment of the substitute lid 55*f* shown in FIG. 7F is similar to that of lid 55*e* except that because of the complete seal to the top of the groove provided by the flange 75*f* and the fact that the web 60*f* is thickened so as to engage the top edge surface 71 of the roll 40, the pointed ridge 61 and its associated lip 77 of the embodiment of FIG. 7*e*** have been omitted.

Figure 5:
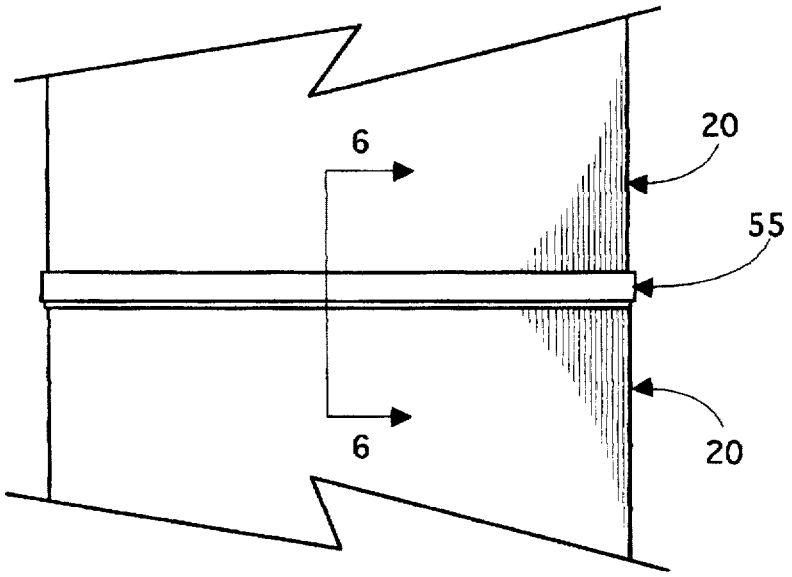
FIG. 5 is a partial side view of two like cans stacked one upon the other and wherein the substitute lid of the present invention provides for a nesting arrangement.

In the embodiments of the invention illustrated to this point, there is provided a nesting means 82 in the form of a short flange or ridge 83 which is of annular configuration and projects axially from the side of the substitute lid 55 opposite to that of the flange 57. The ridge 83 is adjacent the outer periphery of the body portion of the substitute lid, and in fact it can be in the form of an extension of the flange 57 but projecting axially outwardly, rather than inwardly, of the substitute lid. The ridge has an inner cylindrical surface 84, which is substantially of the same diameter as the inner cylindrical surface 64 of the flange 57 so as to be dimensioned to closely encompass the end portion of a second like can 20 (FIGS. 5 and 6) when the cans are stacked one upon the other in an axially aligned relationship. Such a nesting relationship provides stability which prevents stacked cans from sliding laterally one in relation to the other which can so easily occur when there is engagement only between the lower bead 30 of an upper can and the upper bead 46 of a lower can. As best seen in FIG. 6, when the substitute lid 55 is affixed to the bottom of one can 20 as the case would normally be with the illustrated embodiment, the ridge 83 projects downwardly and encompasses the outer periphery 50 of the bead 46 of another can 20 therebelow.

It is not essential that the ridge 83 be continuous around the entire periphery of the substitute lid to provide the nesting effect. It may be notched as shown at 85 in FIG. 8 and also interrupted to provide for the presence of a spout means as will be more fully described below. In fact what has been termed a ridge to provide for nesting may be represented by a number of significantly spaced knobs or tabs about the periphery as more fully described below.

Figure 8:
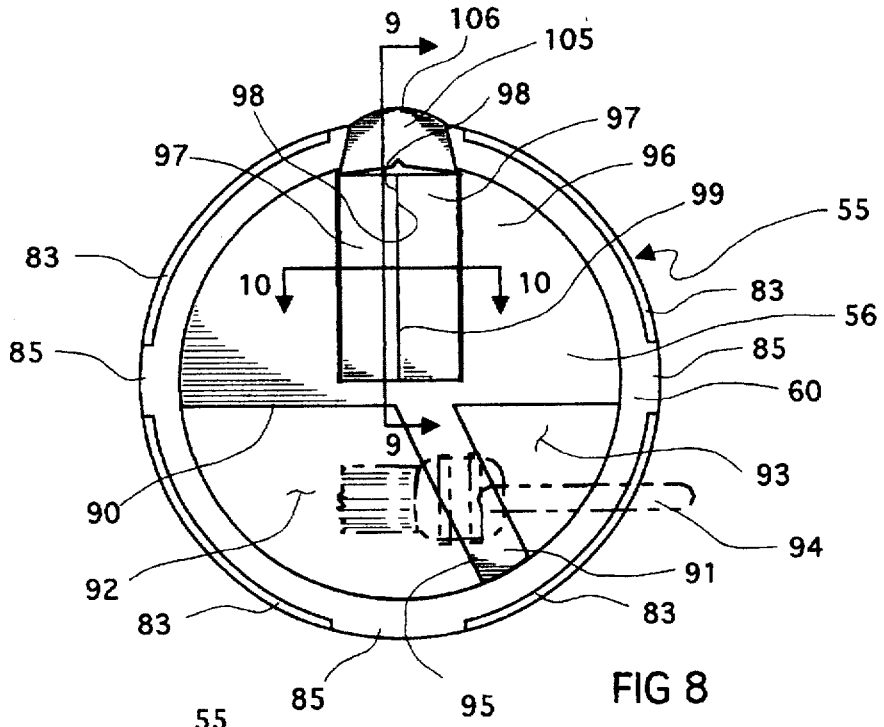
FIG. 8 is a top view of one embodiment of the substitute lid of the present invention installed on the top of an open can as prepared for painting.
Figure 9:
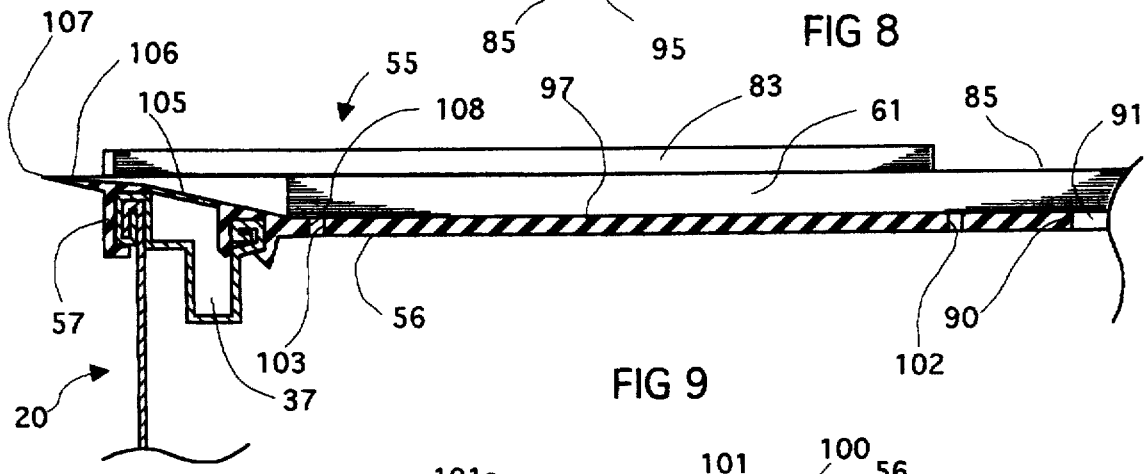
FIG. 9 is a cross sectional view, on an enlarged scale, of the lid of FIG. 8 as seen from the line 9—9 of FIG. 8.
Figure 10:
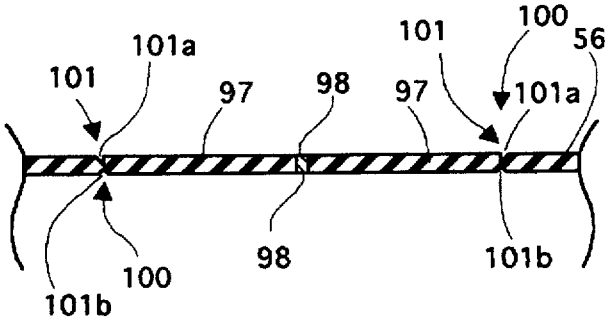
FIG. 10 is a partial cross sectional view, on an enlarged scale, as seen from line 10—10 of FIG. 8.

In FIGS. 8 to 10, it may be seen that the central portion 56 of the substitute lid 55 shown therein is not continuous throughout the area defined within the outer annular web 60. As shown, a significant portion of the central portion 56 contained within an area defining a straight edge 90 represented by a chord line and an arcuate portion represented by the flange 61 is open. In the illustrated embodiment there is provided a strip 91 disposed on a radial line so as to divide the open portion into two separated open sectors 92 and 93, one of which is larger than the other. The open sectors provide for the dipping of a brush 94 into the contents of the open can 20 while straight edges, such as edge 91 and a side edge 95 of the strip 91 provide convenient brush wiping areas. As shown in FIG. 8, the strip 91 may also be used as a rest for the brush with the bristles thereof disposed over the open sector 92. As previously described with the substitute lid installed on top of the open can the groove 37 of the can is sealed against entry of the can contents into the groove, and it is apparent that when the brush is utilized for removing the contents from the can, the groove is not exposed as in the case of such use with a can which has simply had the lid removed.

While the lid as used for a top cover when the can 20 is being utilized for brush dipping has open sectors 92 and 93, in the condition it is supplied and attached to the bottom of the can 20, the open sectors may be closed by closure panels (not shown) the outlines of which are defined by frangible lines. In such a state the entire central portion is therefore closed, and the closure panels can be removed if the lid is to be used as a substitute cover during removal of the contents from the can by brush dipping. It may be found that when the substitute lid is used for pouring purposes as will be more fully described below, it is more convenient to leave the closure panels in place.

Figure 11:
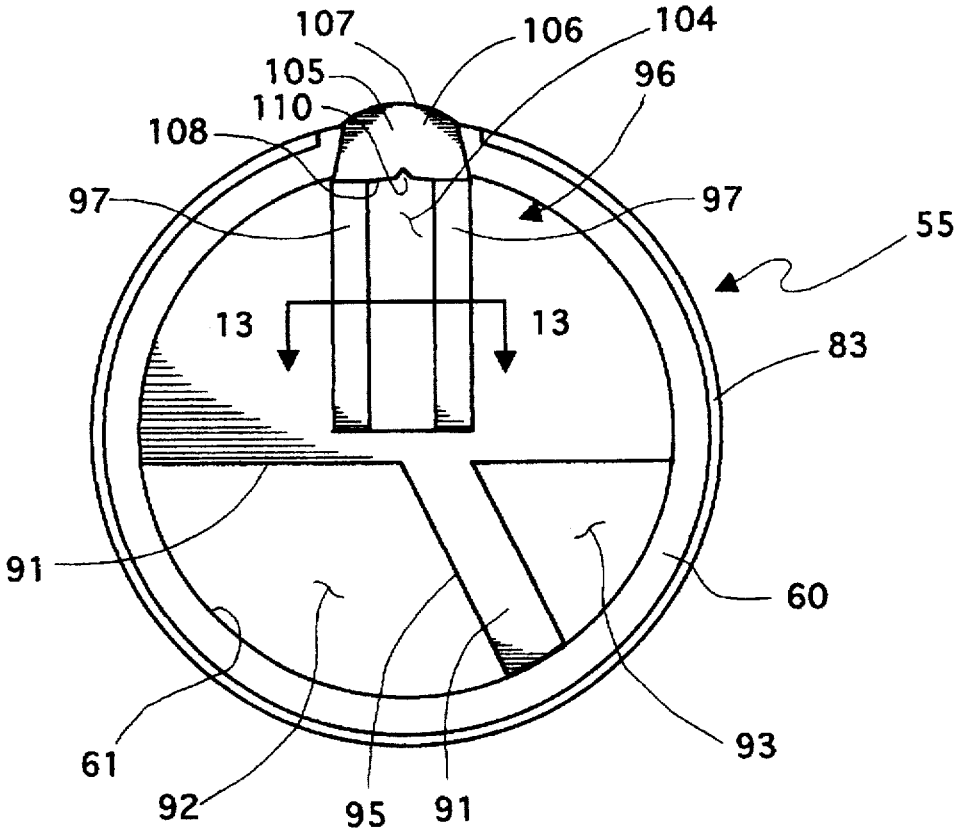
FIG. 11 is a top view of the substitute lid of FIG. 8 but with side flaps of a pouring spout in a raised pouring position.
Figure 12:
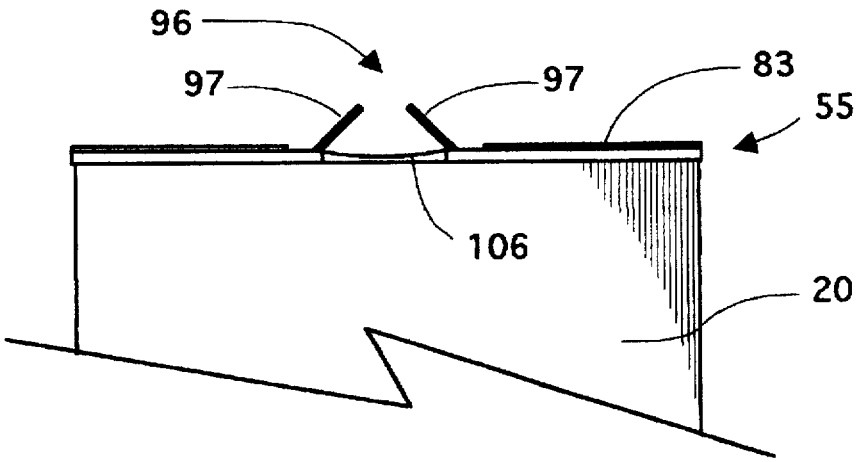
FIG. 12 is a partial elevational view of a can with the substitute lid mounted thereon and the side flaps in the raised position as shown in FIG. 11.
Figure 13:
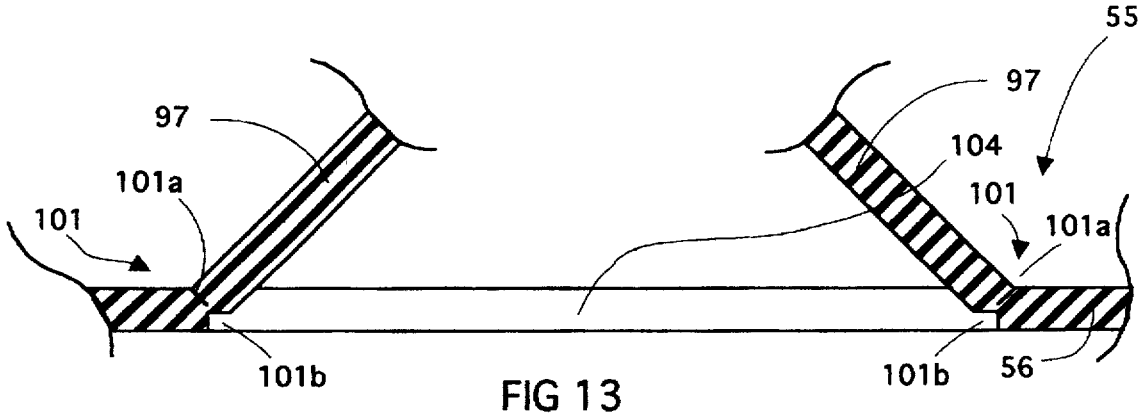
FIG. 13 is a cross sectional view, on an enlarged scale, as seen from the line 13—13 of FIG. 11, with the flaps positioned in a fully opened condition.
Figure 14:
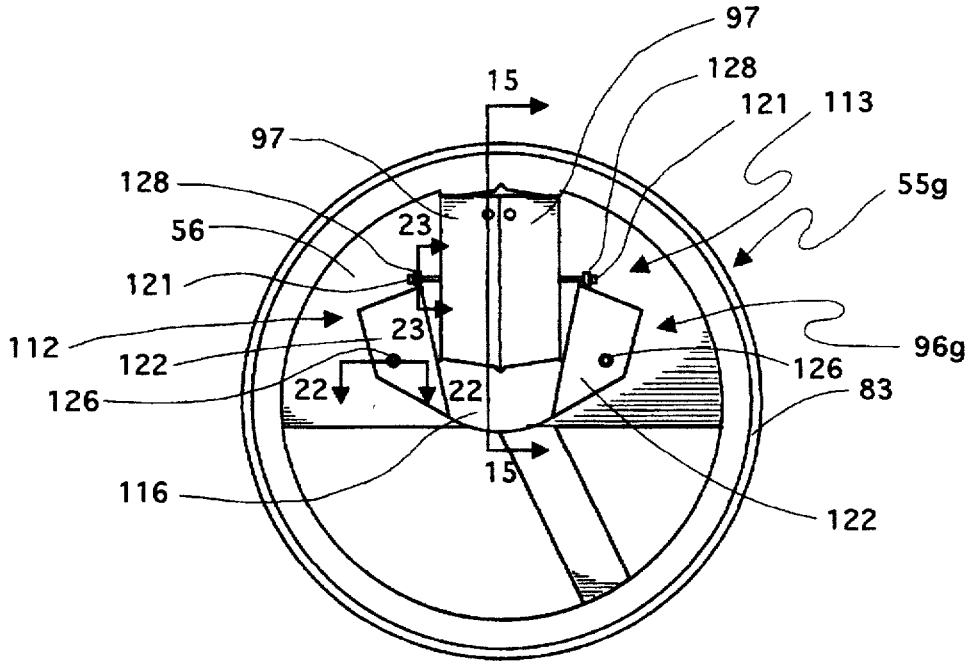
FIG. 14 is a bottom view of the substitute lid as attached to a can but of a different embodiment of the pouring spout means shown in FIG. 8, the primary spout being located in an inactive position.

To permit controlled pouring of the contents from the can a pouring spout means 96 is provided which is movable from a flat position (FIG. 8–10) so as not to detract from the overall flat feature of the substitute lid 55, to a raised pouring position (FIGS. 11 to 13). The pouring means 96 includes a pair of fold-up flaps 97, 97 which are preferably formed integrally with the flat central portion 56 of the substitute lid 55. The flaps 97, 97 in their flat position are in the same plane as the remainder of the central portion 56 and have side edges 98 which meet along a radial line 99. Each flap 97 has an outer side edge which is preferably joined to the adjacent central portion 56, so as to provide a hinge line 100, the hinge lines 100, 100 of the two flaps 97 being parallel to the radial line 99. The hinge lines may be formed by a groove means 101 which includes an upper groove **101*a* formed in the upper surface of the lid and a lower groove 101*b* aligned with the upper groove 101*a* and formed in the lower surface of the lid. Each flap has an inner end edge 102 and an outer end edge 103. The joint of lines 98, 98 and the end edges 103 may actually be in the form of frangible lines so that prior to breaking the flaps 97 away from each other and from the central portion 56 so as to be able to fold the two flaps upwardly, the flaps are entirely integral with the central portion 56. When folded upwardly to a raised pouring position, the fold-up flaps 97, 97 provide sides for a pouring spout means 96 (FIGS. 11 to 13**).

The pouring spout means 96 further includes a special section formed in the substitute lid 55 radially outward from a rectangular pouring opening 104 provided in the central potion 56 when the fold-up flaps 97, 97 are opened to a pouring position. The shoulder provided by the flange portion 61 and the annular web portion 60 is interrupted or replaced by a sloped ramp 105 which slopes upwardly from the outer edge 108 of the opening 104 to the peripheral edge formed at the meeting with the flange 57. The sloped ramp is centrally disposed on the radial line 99. As previously indicated, the ridge 83 forming the nesting means 82 is also interrupted in this area. As a small extension of the ramp 105, there is provided an arcuate lip 106 projecting radially beyond the exterior cylindrical surface of the flange 57. As shown the lip 106 tapers to a fine outer edge 107. A central portion of an inner edge 108 of the ramp, which is the outer edge of the pouring opening 104, is provided with a V-shaped notch 110.

The hinge line 100 of each fold-up flap 97 may be designed to permit the fold-up flaps to be turned up to a substantially vertical position, i.e. at right angles to the central portion 56. However, in the present embodiment, it appears preferable that the grooves **101*a* and 101*b* may be so formed with respect to size and shape to provide a resistant to the folding of the flaps past an angular position, such as about 45 to 60 degrees as best shown in FIG. 13. The positioning of the flaps 97, 97 as shown in FIGS. 11 to 13 may be selected to have the effect of a more controlled flow by the flaps from the opening 104**.

Overall the designs shown in FIGS. 8 to 13 provide for a flat characteristic of the substitute lid 55 prior to the opening of the flaps 97, 97 such as when the substitute lid 55 is attached to the bottom of the can 20 prior to the opening of the can. The illustrated pouring spout means 96 thus placed in the pouring position, i.e. with the fold-up flaps moved to a raised pouring position, provides the shaped opening 104 provided. These features of the pouring spout means in combination with the sloped ramp 105, tapered lip 106 and the notched, sharp edge 108, allows for a controlled pouring function with substantially no run-down of the paint on the outside of the can.

The V-shaped notch formed in the edge 308 assists in directing the pouring of the contents of the can to the center of the sloped ramp 105 especially towards the termination of the pour. This directs the final small flow of the contents to the mid point of the lip 106 which has the sharpest edge 107. Also as the can 20 is returned to its fully upright position, and residual liquid on the ramp flows down the ramp and into the can.

Figure 15:
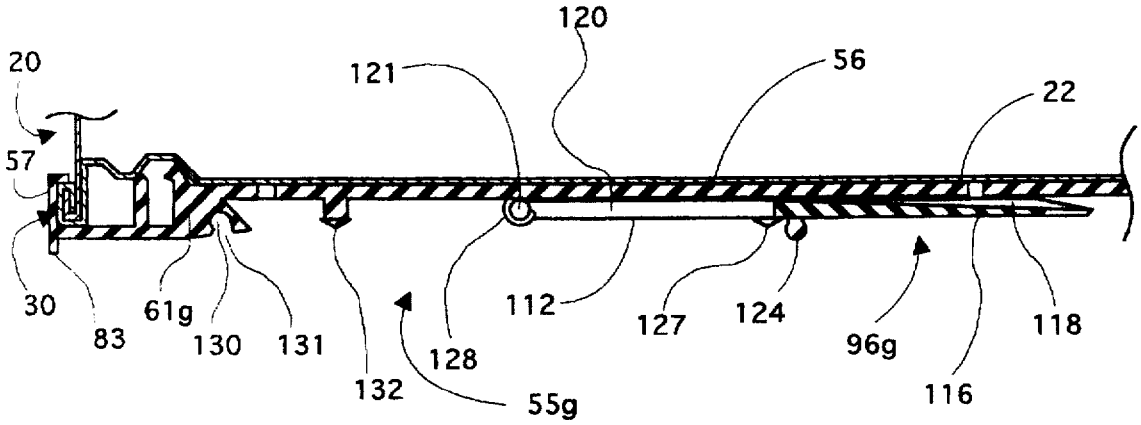
FIG. 15 is a partial cross sectional view of the substitute lid shown in FIG. 14 as seen from the line 15—15 of FIG. 14.
Figure 16:
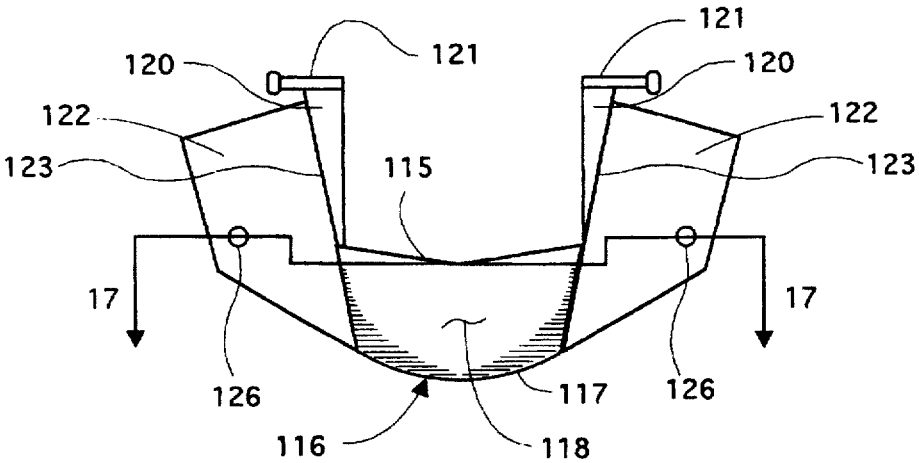
FIG. 16 is a plan view of a movable pouring spout as utilized in the pouring spout means of FIGS. 14 and 15 but shown separate from the lid.
Figure 17:
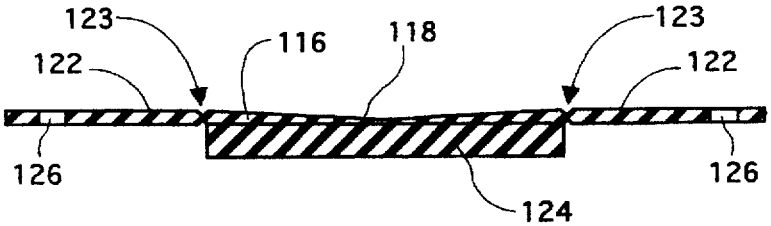
FIG. 17 is an enlarged cross sectional view of the pouring spout of FIG. 16 as seen from line 17—17 of FIG. 16.
Figure 18:
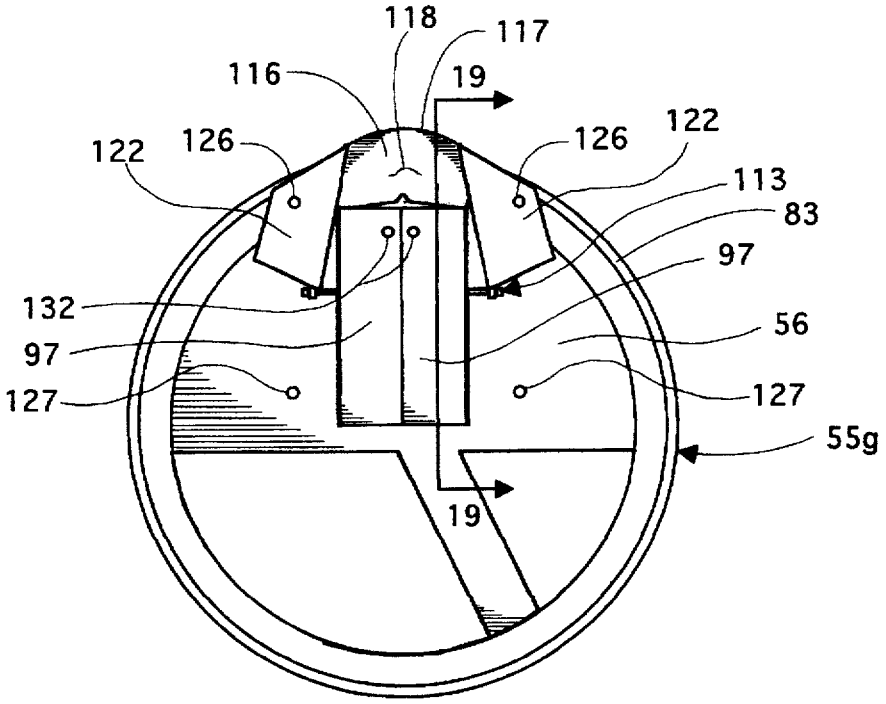
FIG. 18 is a top view of the substitute lid of FIG. 14 as installed on an opened can and with the pouring spout pivoted away from the inactive position shown in FIGS. 14 and 15.
Figure 19:
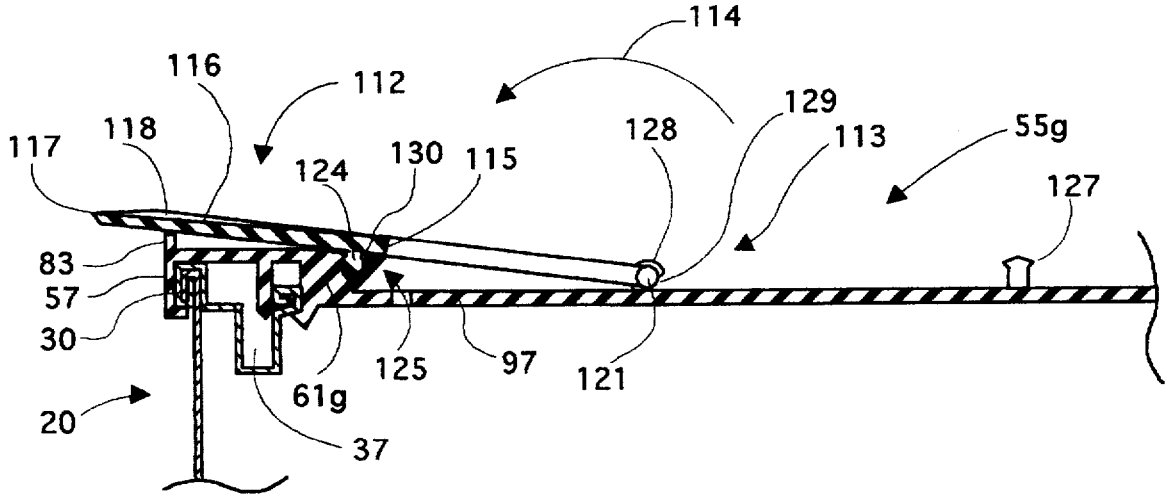
FIG. 19 a partial cross sectional view of the pouring spout as from the line 19—19 of FIG. 18.
Figure 20:
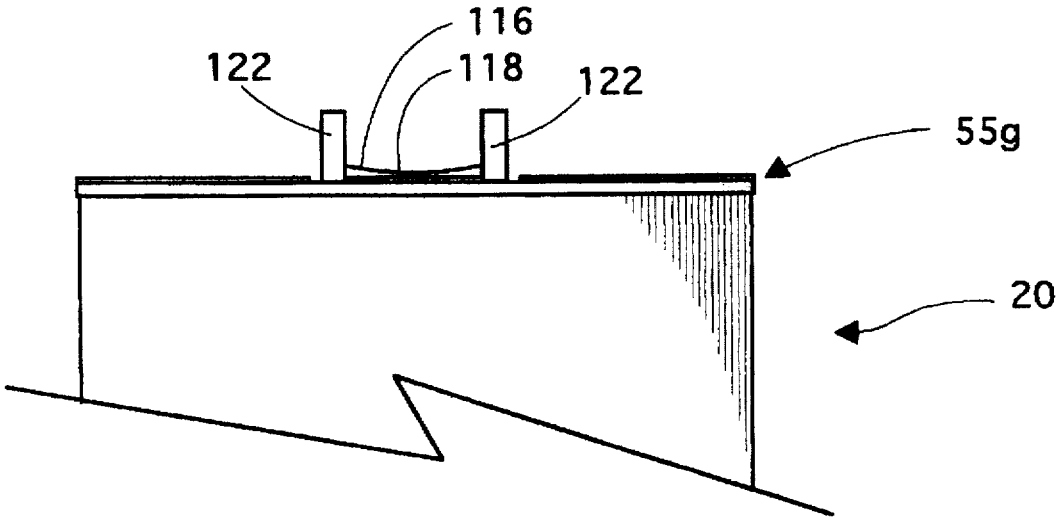
FIGS. 20 is a partial elevational view of a can with the substitute lid mounted thereon and in the condition shown in FIG. 21.
Figure 21:
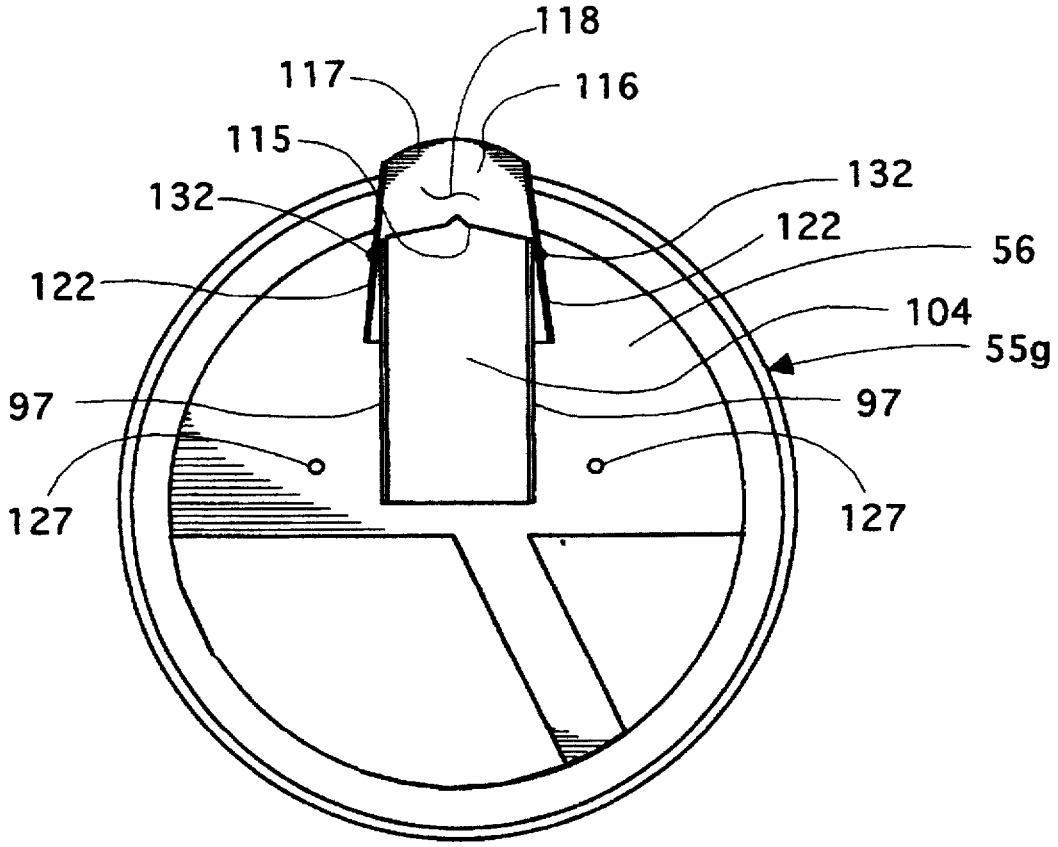
FIG. 21 is a top view similar to FIG. 18 but showing the parts of the substitute lid and pouring spout moved into a pouring position.

Referring now to the embodiment of the substitute lid **55*g* shown in FIGS. 14 to 23, it is of the same basic design as previously described. However, it does not include the ramp 105 and lip 306 projecting from the side of the lid as previously described, but it includes a pouring spout means 96*g* of a different form which does not produce a projection laterally of the side of the lid as does the lip 106 in the earlier embodiment. The substitute lid 55*g* has a pouring spout member 112 which is formed separately from the member forming the substitute lid 55***g*. The pouring spout member 112 is pivotally attached to the lid by way of pivot means 113 which allows the pouring spout member 112 to be swung from an inactive position juxtaposed the central portion 56 of the lid as shown in FIGS. 34 and 15 to an active position as shown in FIGS. 18 and 19, the swinging motion being indicated by an arrow 114 in FIG. 19. The pouring spout 112 would normally remain in the inactive position juxtaposed the central flat portion 56 of the lid until the substitute lid is removed from the bottom of a can and placed on top of the opened can in preparation for pouring. In the inactive position, the pouring spout member 112 is not exposed below the ridge 83 so as to interfere with a nesting relationship with another can therebelow or with the manner in which the can sits on a flat surface.

Figure 22:
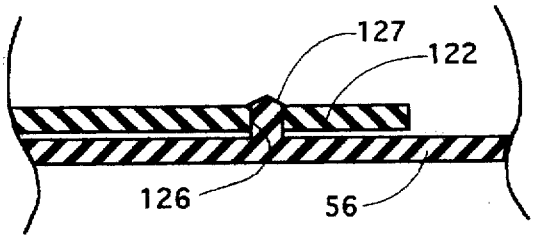
FIG. 22 is an enlarged cross sectional view as seen from line 22—22 of FIG. 14 and illustrating a hold-down means for the pouring spout when in the inactive position.
Figure 23:
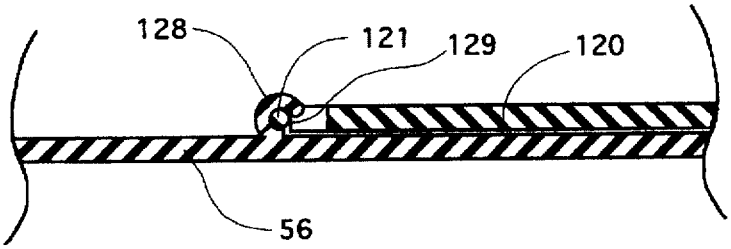
FIG. 23 is an enlarged cross sectional view as seen from the line 23—23 of FIG. 14 and illustrating a pivot connection between the pouring spout to the substitute lid.
Figure 24:
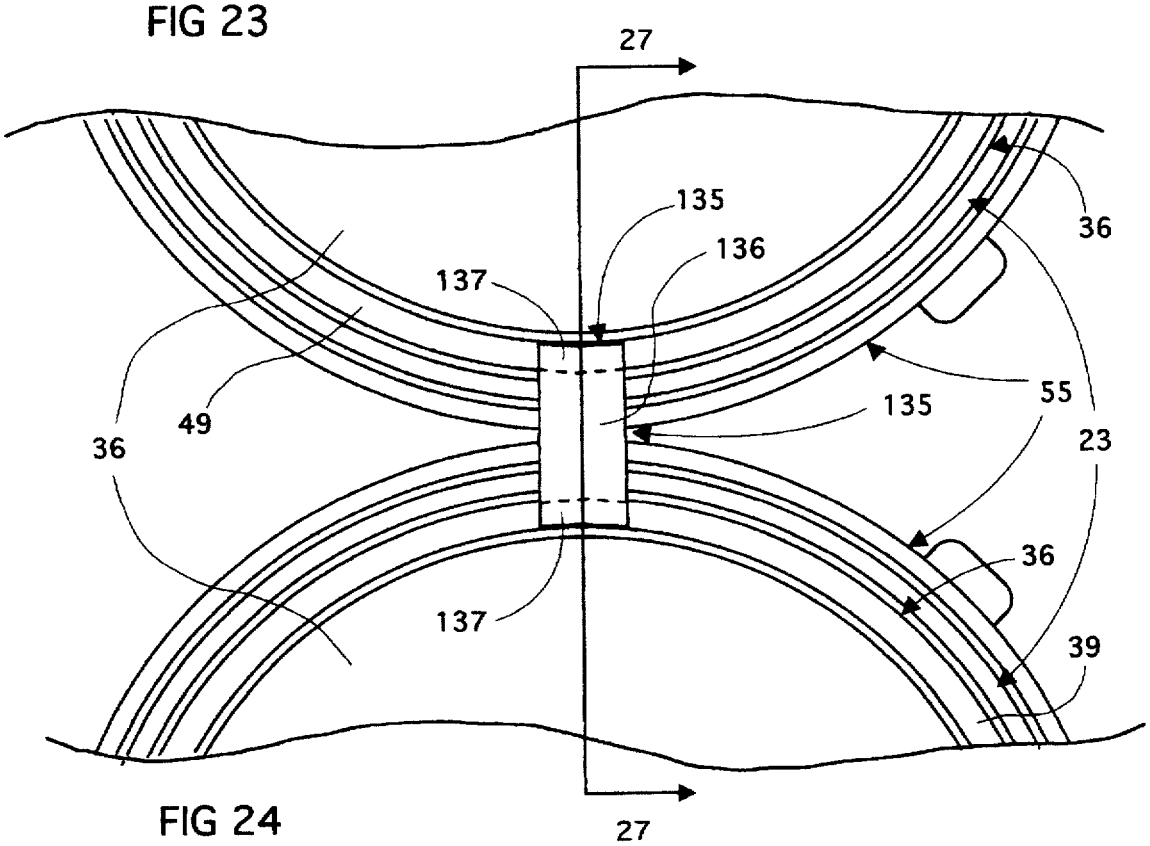
FIG. 24 is a partial top view of a couple of adjacent cans and illustrating a tie element for use in conjunction with the nesting means 21 of the substitute lids of the present invention during stacking.
Figure 25:
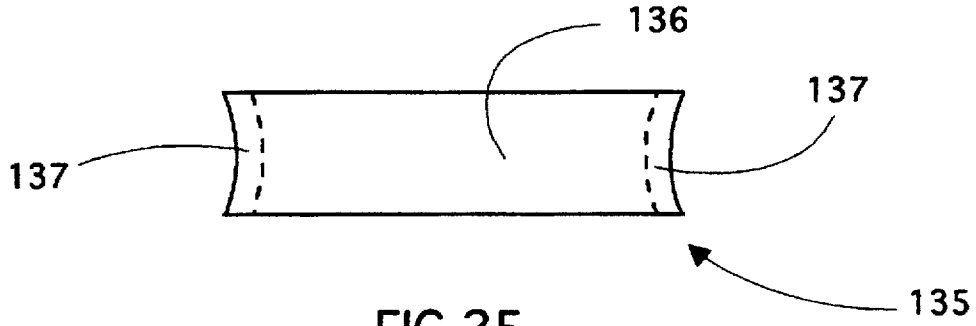
FIG. 25 is a top view of a separate one of the tie elements of FIG. 24.
Figure 26:
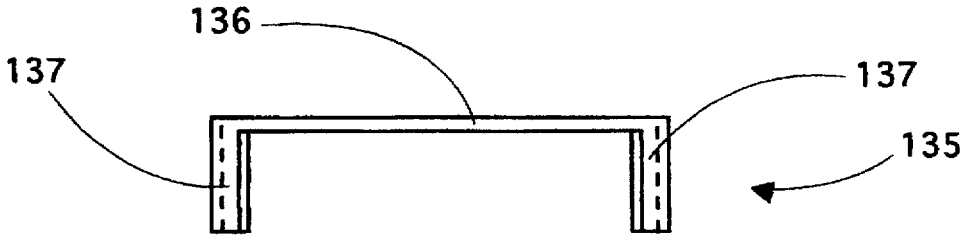
FIG. 26 is a side view of the element of FIG. 25.

As best seen in FIGS. 16 and 17, the pouring spout member 112 includes a central spout portion 116 radially disposed between an inner edge 115 and an outer arcuate edge or lip 117. The central spout portion 116 has in cross section an upper concave surface 118. Extending inwardly from the central spout portion is a pair of spaced supporting side portions 120, 120 which terminate at their inner end in a pair of aligned transversely extending spindles 121, 121 forming part of the pivot means 113 of the pouring spout member 112. Connected to either side of the central spout portion 116 and the side portions 120, 120 along hinge lines 123, 123 are side wings 122, 122. The hinge lines 123, 123, which in an inward direction towards the spindles 121, 121 diverge, are defined by a reduced thickness of the otherwise integrally formed member 112 (FIG. 17). Immediately outward of the inner edge 115 and extending laterally across the width of the central spout portion is a downwardly projecting rib 124 which, as best seen in FIG. 15, preferably of a bulbulous cross section. The rib 124 forms part of a hold down means 125 (FIG. 19) which attaches the pouring spout member 112 to the lid when the pouring spout member has been moved to a pouring position as will be described further below. Each of the side wings 122, 122 of the pouring spout member 112 is provided with a small aperture 126, preferably of circular shape. As best illustrated in FIG. 22, the central portion 56 of the substitute lid 55*g* is provided with upwardly projecting short studs 127, 127 which are sized for an interference fit in the apertures 126 of the side wings 122, 122 when the pouring spout member 112 is flat against the central portion 56 in its inactive position. The spindles 121, 121 of the pouring spout member 112 is received in apertured lugs 128, 128 also formed on the surface of the lid at opposite sides of the hinge lines 100, 100 of the fold-up flaps 97, 97. The apertured lugs 128, 128 which are also part of the pivot means 113, are provided with slots 129 for easy insertion of the spindles 121, 121 when the pouring spout member 112 is attached to the substitute lid 55*g* during its initial assembly. When it is desired to pivot the pouring spout member 112 to its active position, the side wings 122, 122 are first pulled up so as to free them from the studs 127, 127 and the spindles 121, 121 then turn within the apertured lugs 128, 128 as the pouring spout member 112 swings as indicated by arrow 114 (FIG. 19).

As may most readily be noted from FIGS. 15 and 19 the portion of the substitute lid 55*g* which forms the lid connecting means, groove closure means and the nesting means is substantially unmodified in the area which is engaged by the pouring spout member 112 when it is swung into its active or pouring position. The web 61*g* at this point is, however, extended to provide an elongated groove 130, which is of an approximate circular cross section so as to received bulbulous shaped rib 124. The groove 130 has an entrance 131 through which the rib 124 can be pushed to snap the hold down 125 into place as the pouring spout member 112 is established in its pouring position as shown in FIG. 19. The elongated rib 124 received in the elongated 130 also establishes a seal below the central spout portion 116 to prevent leakage thereunder during pouring.

In preparation for pouring after the pouring spout member has been swung to the position shown in FIGS. 18 and 19, the fold-up flaps 97, 97, which each have a projecting stud 132 (FIG. 15), are moved up to a vertical position thus providing the pouring opening 104 radially inward of the inner edge 115 of the central pouring spout portion 116. The side wings 122, 122 are then folded up along hinge lines 123, 123, also to a vertical orientation so as to engage the fold-up flaps in their vertical orientation. The studs 132, 132 projecting outward from the fold-up flaps are positioned to enter apertures 126, 126 of the side wings, and due to an interference fit effectively lock the fold-up flap 97, 97 and side wings 122, 122 together in the standing vertical positions thus providing for controlled pouring of the can contents through the pouring opening 104 and between the sides provided by the vertically oriented fold-up flaps and wings and over the central pouring portion 116.

As previously described, one feature of the present invention is to provide a nesting means 82 in the substitute lid 55 so as to enable cans 20 to be stacked one upon the other and whereby lateral displacement of one can relative to the can thereunder is prevented thereby providing stability in the stack. It is also desirable when aligned vertical stacks are placed side-by-side, such as in the building of a display which may be of considerable height to also interlock side-by-side stacks so as to increase the stability of the overall display. There is shown in FIGS. 24 to 27 a can interlock device or lateral tie means 135 for use in combination with the substitute lid of the present invention.

Figure 27:
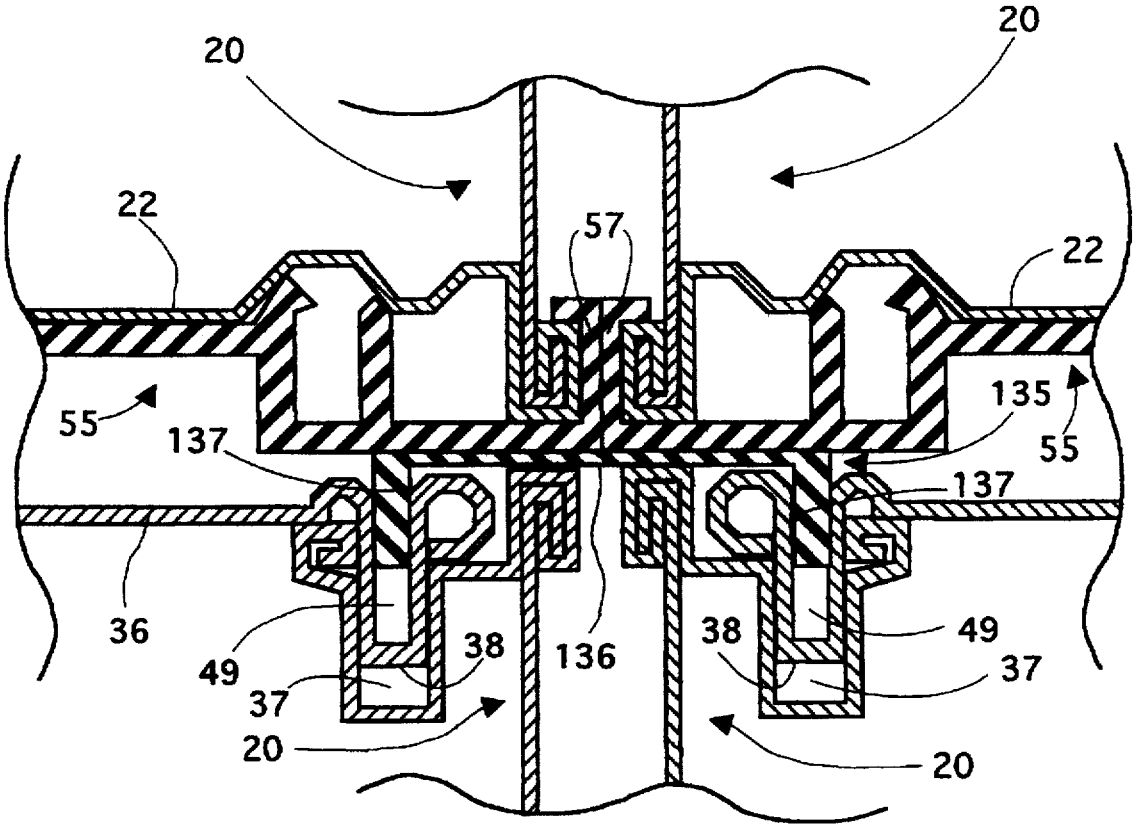
FIG. 27 is a cross sectional view as seen from line 27—27 of FIG. 24, but showing the relationship of the tie elements to the substitute lid when additional cans are stacked in aligned positions thereabove.

As previously described the top closure means 23 of the can 20 includes a lid 36 which has a downwardly extending flange 38 formed by a reverse bend sized to be received in the groove 37 to tightly hold the lid 36 in a closed position. The reverse bend of flange 38 provides an upwardly facing open, annular groove 49. The lateral tie means 135 which may also be formed of a relatively resilient plastic material, includes a thin flat web 136 and a pair of flanges 137, 137 projecting perpendicularly therefrom at opposite ends. Depending on the width of the tie means 135, the flanges 137, 137 may have an outward curvature in cross section on a radius equal to that of the groove 49 of the can lid 36. The thickness of the flanges 137, 137 is selected for a close fit within the groove 49. The length of the web 136, i.e. the distance between the flanges 137, 137, is selected so that when substitute lids 55, 55 are attached to the cans in adjacent stacks of the cans in the display the outer cylindrical surfaces of the flanges 57, 57 of the substitute lids 55 engage as shown in FIG. 27. As previously indicated in relation to the embodiment shown in FIG. 8 the nesting ridge 83 is notched at 85 to accommodate the web 136 of the lateral tie means 135.

Figure 28:
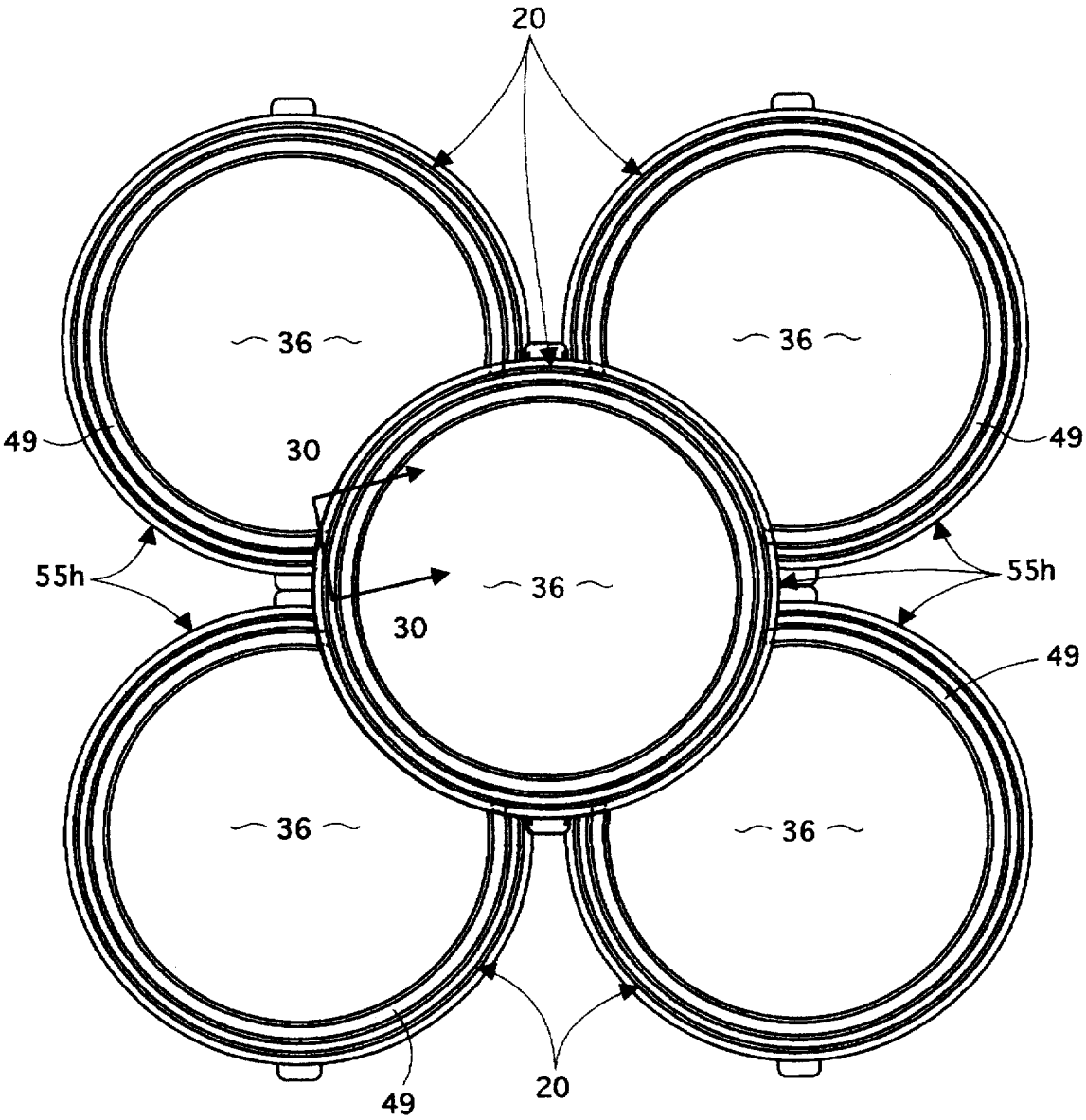
FIG. 28 is a top view of a different type of stack of cans wherein a substitute lid of the present invention is used to interlock the cans in the stack, the nesting means of the substitute lids being of a different design than that shown in previous/embodiments.
Figure 29:
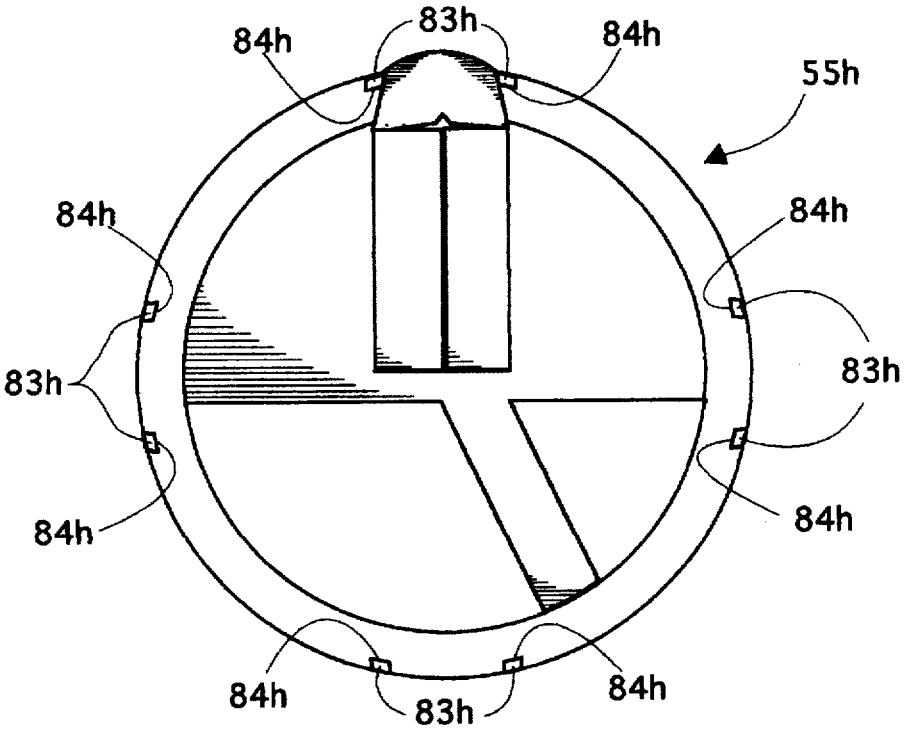
FIG. 29 is a bottom view of a substitute lid as installed on a can and usable for stacking as illustrated in FIG. 28.
Figure 30:
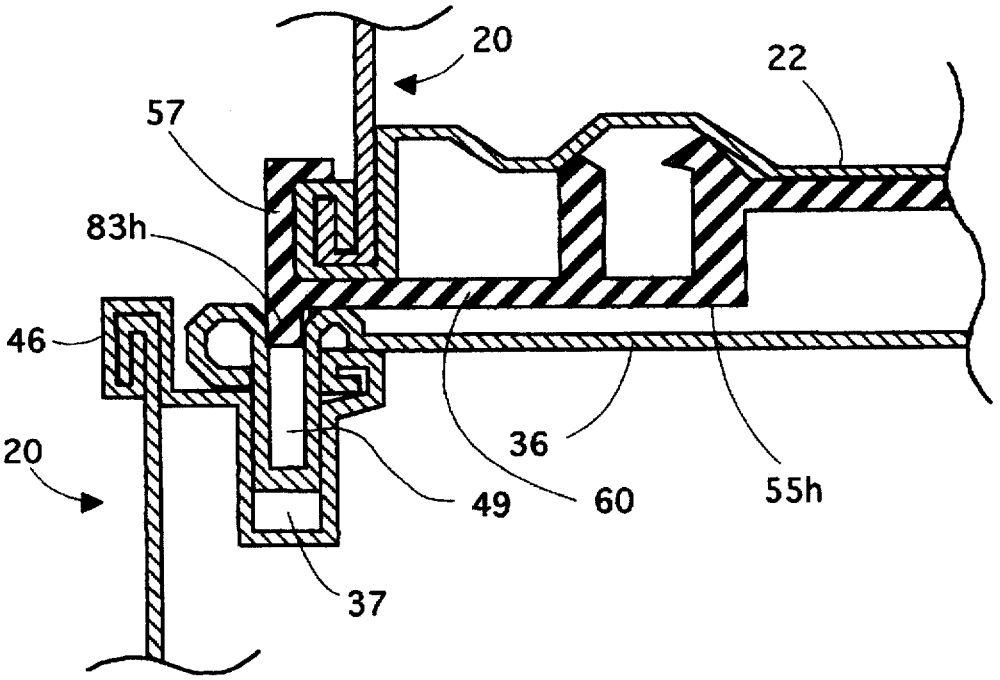
FIG. 30 is a partial cross sectional view of the substitute lid as seen from line 29—29 of FIG. 28.

It is also desirable to provide for lateral interlocking when the cans 20 are not stacked in vertical alignment, i.e. the cans are in effect staggered from one horizontal row to the next, or when a display is built in a pyramid pile. It is possible to modify the nature of the nesting means 82 to provide stability by an interlocking effect and at the same time still be usable for the above described type of nesting when the cans are stacked in vertical alignment. As previously indicated the same effect as having a continuous raised ridge at the periphery can be achieved by an interrupted or non continuous ridge. This is also possible even by using a plurality of widely spaced tabs or knobs about the surface as indicated at 83h in FIGS. 29 and 30. The tabs have inner surfaces 84h which engage the exterior surface 50 of the upper bead 46 of the next lower can when stacked in vertical alignment so as to function in the same stabilizing manner as the continuous ridge. However, the tabs 83h can be selectively spaced and of a selected width to fit into the grooves 49 of the next lower set of cans 20 (see FIG. 30) if the stacking is not in vertical alignment, such as shown in FIG. 28.

While various embodiments of the present invention have been illustrated in the accompanying drawing and described above, it will be apparent to those skilled in the art that other modifications are available which are within the spirit of the present invention as defined in the appending claims.

What I claim is:

1. A substitute lid for a can of the type for containing contents such as paint and the like, the can having a tubular body, a flat bottom member, and a top closure means formed at a top end of the body, said top closure means including means forming an upward facing groove integrally within an upper end of the tubular body and a removable top lid having a downwardly projecting flange means for tight engagement within said groove;

said substitute lid comprising:

a substantially flat body portion defining an opening means therethrough, said body portion being disposed within an outer periphery substantially equal in size and shape to said body of said can, a flange about the periphery of said body portion and projecting axially from a first side surface of said body portion of said substitute lid, said flange providing can attachment means for removably holding said substitute lid adjacent one end of said can, said flange having an inner surface sized to closely encompassing and tightly engaging a portion of said can at one end of said tubular body, and groove closure means projecting from said one side surface of said body portion and spaced radially inward of said flange, said substitute lid being removable from said one end of said can and being attachable over said top end of said can subsequent to removal of said top lid, whereby said groove closure means contacts the groove forming means when said substitute lid is attached over said top end of the can and prevents entry of said contents of the can into said groove during removal of said contents from said can through said opening.

2. A substitute lid as defined in claim 1, wherein said means forming said upward facing groove of said can has an inner edge defining an outer rim of a top can opening, said top opening being normally closed by said removable top lid, said rim being located radially inward of said groove of said can, and wherein said groove closure means includes a surface engagable with said outer rim upon attachment of said substitute lid to said top end of said can.

3. A substitute lid as defined in claim 2, wherein said body portion of said substitute lid includes a flat central portion surrounded by an outer annular section forming said flange and said groove closure means, said outer annular section including a flat, substantially continuous annular web between said flat central portion and said flange.

4. A substitute lid as defined in claim 3, wherein said groove closure means includes an annular flange means projecting perpendicularly from said annular web and being disposed concentrically within and spaced from said flange forming said attachment means, and wherein said annular web is disposed in a plane axially displaced from but parallel to said central portion.

5. A substitute lid as defined in claim 4, wherein said flange forming said attachment means surrounds said flat annular web and projects from one side thereof.

6. A substitute lid as defined in claim 4, and further comprising:

nesting means disposed substantially coaxial with said flange and projecting from an opposite side of said annular web, said nesting means having an inner surface dimensioned to closely encompass an end portion of another like can whereby the cans can be stacked one upon the other in a nesting relationship.

7. A substitute lid as defined in claim 5, wherein the opening means through said body portion defines a pouring opening having an outer edge adjacent said outer annular section, and wherein said substitute lid further comprises:

a pouring spout means associated with said pouring opening and being movable from a first position in a flat relationship to said body portion to a raised pouring position, whereby on removal of said top lid of said can, said substitute lid, having been removed from said one end of said can, is attached to said top end of said can and said pouring spout means is movable to said raised pouring position to assist in controlled pouring of the contents from said can.

8. A substitute lid as defined in claim 7, wherein said flat central portion includes a pair of fold-up flaps normally disposed in a flat position in the same plane as said flat central portion and joined thereto along a pair of hinge lines, said fold-up flaps being pivotable about said hinge lines to be turned to a raised position to form at least in part said pouring spout means, the raising of said fold-up flaps from said flat position providing said pouring opening in said body portion of said substitute lid.

9. A substitute lid as defined in claim 8, wherein said hinge lines of said fold-up flaps extend substantially parallel to and straddle a radial line of said substitute lid.

10. A substitute lid as defined in claim 9, wherein said hinge lines are provided by a pair of groove means in at least one side surface of said flat central surface.

11. A substitute lid as defined in claim 9, wherein said outer annular section has formed in said annular web a ramp means centrally disposed on said radial line and defining a pouring spout ramped upwardly from said pouring opening.

12. A substitute lid as defined in claim 11, wherein said pouring spout has a top pouring surface of concave cross section, said pouring surface terminating in a lip outwardly of said flange.

13. A substitute lid as defined in claim 10, wherein said groove means defining said hinge lines of said fold-up flaps are shaped and sized to resist upward folding past an angle of 45 to 60 degrees relative to said flat central portion of the substitute lid.

14. A substitute lid as defined in claim 7, and further comprising;

a pouring spout member having pivotal connecting means joining said pouring spout member to said flat central portion, said pouring spout member including a central spout portion, said pivotal connecting means allowing pivoting of said central spout portion from a flat position juxtaposed said flat central portion to an active position radially outward of said outer edge of said pouring opening.

15. A substitute lid as defined in claim 9, and further comprising:

a pouring spout member having pivotal connecting means joining said pouring spout member to said flat central portion, said pivotal connecting allowing pivoting of said pouring spout member from a flat position juxtaposed said flat central portion to an active position radially outward of said outer edge of said pouring opening, said pouring spout member having first attachment means for affixing said pouring spout member against said body portion of said substitute lid in said active position.

16. A substitute lid as defined in claim 15, wherein said pouring spout member includes a central pouring spout portion overlying said outer annular section in said active position and being disposed on said radial line in said active position.

17. A substitute lid as defined in claim 16, wherein said pouring spout member includes fold-up wings on either side of said pouring spout portion, said fold-up wings having second attachment means for affixing said fold-up wings in a folded up condition to said fold-up flaps in said raised position, whereby together said fold-up wings and said fold up flaps form side walls for said pouring opening and said pouring spout portion in said active position.

18. A substitute lid as defined in claim 17, wherein said fold-up wings are provided with third attachment for affixing said pouring spout member in said flat position juxtaposed said flat central portion of said substitute lid.

19. A pouring device for use with a can of the type for containing contents, such as paint and like contents, said can having a cylindrical wall portion, a relatively flat bottom member at a lower end of said cylindrical wall portion, and a top closure means including a removable top lid at a top end of said can, said pouring device comprising a substitute lid provided by a substantially flat body portion formed of plastic-like material, said body portion of said substitute lid having a circular outer periphery of a diameter substantially equal to that of the cylindrical wall portion of the can and a means for defining a pouring opening therethrough, a circular flange extending about said periphery of said body portion and projecting axially from one side of said body portion, said circular flange having an inner surface of a diameter for closely encompassing a portion of said can adjacent said ends thereof and thereby removably attaching said device to either end of said can, and pouring spout means associated with said pouring opening and being movable from a first position in a flat relationship to said body portion to a raised pouring position, whereby on removal of said top lid from said can, said pouring device, having been removed from the said one end of the can, is attachable to said top end of said can, and said pouring spout means is movable to said raised pouring position to assist in controlled pouring of the contents from said can.

20. A substitute lid as defined in claim 19, wherein said body portion of said substitute lid includes a flat central portion surrounded by an outer annular section forming said flange, said outer annular section including a flat, substantially continuous annular web between said flat central portion and said flange.

21. A substitute lid as defined in claim 20, wherein said flat central portion includes a pair of fold-up flaps normally disposed in a flat position in the same plane as said flat central portion and joined thereto along a pair of hinge lines, said fold-up flaps being pivotable about said hinge lines to be turned to a raised position to form at least in part said pouring spout means, the raising of said fold-up flaps from said flat position providing said pouring opening in said body portion of said substitute lid, said hinge lines of said fold-up flaps extending substantially parallel to and straddle a radial line of said substitute lid.

22. A substitute lid as defined in claim 21, and further comprising;

a pouring spout member having pivotal connecting means joining said pouring spout member to said flat central portion, said pouring spout member including a central spout portion, said pivotal connecting means allowing pivoting of said central spout portion from a flat position juxtaposed said flat central portion to an active position radially outward of said outer edge of said pouring opening.

23. A substitute lid as defined in claim 21, and further comprising:

a pouring spout member having pivotal connecting means joining said pouring spout member to said flat central portion, said pivotal connecting means allowing pivoting of said pouring spout member from a flat position juxtaposed said flat central portion to an active position radially outward of said outer edge of said pouring opening, said pouring spout member having first attachment means for affixing said pouring spout member against said body portion of said substitute lid in said active position, said pouring spout member including a central pouring spout portion overlying said outer annular section in said active position and being disposed on said radial line in said active position.

24. A substitute lid as defined in claim 23, wherein said pouring spout member includes fold-up wings on either side of said pouring spout portion, said fold-up Wings having second attachment means for affixing said fold-up wings in a folded up condition to said fold-up flaps in said raised position, whereby together said fold-up wings and said fold up flaps form side walls for said pouring opening and said pouring spout portion in said active position.

25. A substitute lid for a first container of containers of the type having a tubular body and flat top and bottom closure means joined to opposite end portions of said tubular body, said substitute lid comprising a substantially flat central portion having an outer periphery, a flange adjacent said outer periphery of said central portion and projecting axially from one side of said central portion, said flange having an inner surface sized to encompass and engage one end portion of said first of said containers for removable attachment of said lid to said first container, and a nesting means adjacent the outer periphery of said body portion of said substitute lid and projecting axially from a side of said body portion opposite to said flange, said nesting means having an inner surface dimensioned to closely encompass an end portion of a second like container whereby said containers can be stacked one upon the other in a nesting relationship.

26. A substitute lid as defined in claim 25, wherein said nesting means is a substantially continuous annular ridge substantially axially aligned with said flange.

27. A substitute lid as defined in claim 26, wherein said ridge is interrupted to provide notches at predetermined locations therearound.

28. A substitute lid as defined in claim 25, wherein said container is a can of the type having a top closure means formed at a top end of a cylindrical shaped body, said closure means including means forming an upwardly facing groove integrally within an upper end of said body, and a removable lid having a downwardly projecting flange formed by a reverse bend and defining an upwardly facing groove in a top peripheral portion of said lid, and wherein said nesting means of said substitute lid includes a plurality of circumferential spaced tabs, said tabs being shaped to be received in said upwardly facing groove in a removable lid of another can stacked therebelow in a non-aligned relationship.

* * * * *